US011363933B2

(12) United States Patent
Lewis

(10) Patent No.: US 11,363,933 B2
(45) **Date of Patent: *Jun. 21, 2022**

(54) CLEANING SYSTEM FOR AUTONOMOUS ROBOT

(71) Applicant: iRobot Corporation, Bedford, MA (US)

(72) Inventor: Oliver Lewis, Waltham, MA (US)

(73) Assignee: iRobot Corporation, Bedford, MA (US)

( * ) Notice: Subject to any disclaimer, the term of this patent is extended or adjusted under 35 U.S.C. 154(b) by 185 days.

This patent is subject to a terminal disclaimer.

(21) Appl. No.: 16/535,598

(22) Filed: Aug. 8, 2019

(65) Prior Publication Data

US 2020/0015647 A1 Jan. 16, 2020

Related U.S. Application Data

(63) Continuation of application No. 14/568,180, filed on Dec. 12, 2014, now Pat. No. 10,568,483.

(51) Int. Cl.

| | |
|---|---|
| ***A47L 11/40*** | (2006.01) |
| ***A47L 9/04*** | (2006.01) |
| ***A47L 9/02*** | (2006.01) |

(52) U.S. Cl.

CPC ..... *A47L 11/4041* (2013.01); *A47L 9/02* (2013.01); *A47L 9/0472* (2013.01); (Continued)

(58) Field of Classification Search

CPC .... A47L 9/0466; A47L 9/0472; A47L 9/0488; A47L 9/00; A47L 9/04; A47L 11/04041; (Continued)

(56) References Cited

U.S. PATENT DOCUMENTS

| | | | |
|---|---|---|---|
| 3,978,539 | A | 9/1976 | Yonkers |
| 6,389,329 | B1 | 5/2002 | Colens |

(Continued)

FOREIGN PATENT DOCUMENTS

| | | |
|---|---|---|
| AU | 2015361241 | 6/2017 |
| AU | 2015361241 | 11/2019 |

(Continued)

OTHER PUBLICATIONS

U.S. Appl. No. 14/568,180, filed Dec. 12, 2014, Cleaning System for Autonomous Robot.

(Continued)

*Primary Examiner* — Monica S Carter
*Assistant Examiner* — Abbie E Quann
(74) *Attorney, Agent, or Firm* — Schwegman Lundberg & Woessner, P.A.

(57) ABSTRACT

An autonomous cleaning robot comprises a chassis, at least one motorized drive wheel mounted to the chassis and arranged to propel the robot across a surface, and a pair of cleaning rollers mounted to the chassis and having outer surfaces exposed on an underside of the chassis and to each other. The cleaning rollers are drivable to counter-rotate while the robot is propelled, thereby cooperating to direct raised debris upward into the robot between the rollers. A side brush is further mounted to the chassis to rotate beneath the chassis adjacent a lateral side of the chassis about an upwardly extending side brush axis, and the outer surface of a first of the cleaning rollers of the pair extends laterally beyond the outer surface of a second of the cleaning rollers of the pair and laterally beyond the side brush axis, such that the first cleaning roller defines a cleaning width spanning the side brush axis.

16 Claims, 17 Drawing Sheets

(52) U.S. Cl.
CPC ..... *A47L 9/0477* (2013.01); *A47L 9/0488* (2013.01); *A47L 2201/00* (2013.01); *A47L 2201/06* (2013.01)

(58) Field of Classification Search
CPC ..... A47L 2201/00; A47L 2201/06; A47L 2201/04
USPC ..... 15/42, 319, 340.4
See application file for complete search history.

(56) References Cited

U.S. PATENT DOCUMENTS

| | | | | |
|---|---|---|---|---|
| 6,532,404 | B2 | 3/2003 | Colens | |
| 6,594,844 | B2 | 7/2003 | Jones | |
| 6,690,134 | B1 | 2/2004 | Jones et al. | |
| 6,781,338 | B2 | 8/2004 | Jones et al. | |
| 6,809,490 | B2 | 10/2004 | Jones et al. | |
| 6,965,209 | B2 | 11/2005 | Jones et al. | |
| 7,155,308 | B2 | 12/2006 | Jones | |
| 7,173,391 | B2 | 2/2007 | Jones et al. | |
| 7,196,487 | B2 | 3/2007 | Jones et al. | |
| 7,388,343 | B2 | 6/2008 | Jones et al. | |
| 7,389,156 | B2 | 6/2008 | Ziegler et al. | |
| 7,448,113 | B2 | 11/2008 | Jones et al. | |
| 7,571,511 | B2 | 8/2009 | Jones et al. | |
| 7,578,020 | B2 | 8/2009 | Jaworski et al. | |
| 7,636,982 | B2 | 12/2009 | Jones et al. | |
| 7,761,954 | B2 | 7/2010 | Ziegler et al. | |
| 8,239,992 | B2 | 8/2012 | Schnittman et al. | |
| 8,347,444 | B2 | 1/2013 | Schnittman et al. | |
| 8,370,985 | B2 | 2/2013 | Schnittman et al. | |
| D699,010 | S | 2/2014 | Gilbert, Jr. | |
| 8,839,477 | B2 | 9/2014 | Schnittman et al. | |
| D716,510 | S | 10/2014 | Gilbert, Jr. | |
| 8,881,339 | B2 | 11/2014 | Gilbert, Jr. et al. | |
| 8,955,192 | B2 | 2/2015 | Gilbert, Jr. et al. | |
| D728,877 | S | 5/2015 | Therrien | |
| D747,052 | S | 1/2016 | Therrien | |
| 10,568,483 | B2 | 2/2020 | Lewis | |
| 2002/0016649 | A1 | 2/2002 | Jones | |
| 2002/0120364 | A1 | 8/2002 | Colens | |
| 2002/0129462 | A1 | 9/2002 | Matusz et al. | |
| 2003/0025472 | A1 | 2/2003 | Jones et al. | |
| 2004/0020000 | A1 | 2/2004 | Jones | |
| 2004/0049877 | A1 | 3/2004 | Jones et al. | |
| 2004/0074027 | A1 | 4/2004 | Grey | |
| 2004/0172784 | A1 | 9/2004 | Downey et al. | |
| 2004/0187249 | A1* | 9/2004 | Jones | A47L 9/1409 15/319 |
| 2004/0187457 | A1 | 9/2004 | Colens | |
| 2004/0207355 | A1 | 10/2004 | Jones et al. | |
| 2005/0067994 | A1 | 3/2005 | Jones et al. | |
| 2005/0204717 | A1 | 9/2005 | Colens | |
| 2006/0010638 | A1 | 1/2006 | Shimizu et al. | |
| 2006/0236491 | A1 | 10/2006 | Baek | |
| 2006/0236492 | A1 | 10/2006 | Sudo | |
| 2007/0266508 | A1 | 11/2007 | Jones et al. | |
| 2008/0140255 | A1 | 6/2008 | Ziegler et al. | |
| 2008/0155768 | A1 | 7/2008 | Ziegler et al. | |
| 2008/0307590 | A1 | 12/2008 | Jones et al. | |
| 2010/0037418 | A1* | 2/2010 | Hussey | B60L 15/2036 15/319 |
| 2010/0049365 | A1 | 2/2010 | Jones et al. | |
| 2010/0257690 | A1 | 10/2010 | Jones et al. | |
| 2010/0257691 | A1 | 10/2010 | Jones et al. | |
| 2010/0263158 | A1 | 10/2010 | Jones et al. | |
| 2011/0239382 | A1* | 10/2011 | Lee | B60B 19/12 15/3 |
| 2013/0152332 | A1 | 6/2013 | Jang | |
| 2014/0259475 | A1* | 9/2014 | Doughty | A47L 9/009 15/52.1 |
| 2016/0166127 | A1 | 6/2016 | Lewis | |

FOREIGN PATENT DOCUMENTS

| | | |
|---|---|---|
| CA | 2970635 | 6/2016 |
| CN | 103654619 | 3/2014 |
| EP | 3229653 | 10/2017 |
| EP | 3229653 | 10/2019 |
| JP | 2004195215 | 7/2004 |
| JP | 2014061375 | 4/2014 |
| JP | 2014512246 | 5/2014 |
| JP | 2015520639 | 7/2015 |
| WO | 2016093910 | 6/2016 |

OTHER PUBLICATIONS

"Japanese Application Serial No. 2017-531471, Notification of Reasons for Refusal mailed w/English Translation dated Nov. 12, 2019", 5 pgs.
"European Application Serial No. 15771405.6, Response filed Feb. 21, 2018 to Communication pursuant to Rules 161(1) and 162 EPC dated Aug. 24, 2017", 13 pgs.
"European Application Serial No. 15771405.6, Response filed Jan. 8, 2019 to Communication Pursuant to Article 94(3) EPC dated Sep. 3, 2018", 11 pgs.
"European Application Serial No. 15771405.6, Office Action dated May 13, 2019", 7 pgs.
"Application Serial No. 2,970,635, Voluntary Amendment filed Aug. 30, 2017", 7 pgs.
"U.S. Appl. No. 14/568,180, PTO Response to Rule 312 Communication dated Dec. 26, 2019", 2 pgs.
"Japanese Application Serial No. 2017-531471, Voluntary Amendment filed Aug. 20, 2019", w English claims, Voluntary Amendment and PPH Request, 13 pgs.
"European Application Serial No. 19203328.0, Communication Pursuant to Article 94(3) EPC dated Apr. 17, 2020", 4 pgs.
"Japanese Application Serial No. 2017-531471, Response Filed May 12, 2020 to Notification of Reasons for Refusal dated Nov. 12, 2019", w English Claims, 13 pgs.
"Chinese Application Serial No. 201510399124.6, Decision of Rejection dated Jan. 10, 2020", w English translation, 11 pgs.
"European Application Serial No. 19203328.0, Communication Pursuant to Article 94(3) EPC dated Mar. 16, 2021", 3 pgs.
"Chinese Application Serial No. 201510399124.6, Notice of Reexamination dated May 28, 2021", w/o English Translation, 8 pgs.
"Australian Application Serial No. 2015361241, First Examination Report dated Jun. 28, 2019", 2 pgs.
"European Application Serial No. 15771405.6, Communication Pursuant to Article 94(3) EPC dated Sep. 3, 2018", 4 pgs.
"U.S Appl. No. 14/568,180, Notice of Allowance dated Jul. 11, 2019", 10 pgs.
"Chinese Application Serial No. 201510399124.6, Office Action dated Jun. 24, 2019", W English Translation, 14 pgs.
"International Application Serial No. PCT US2015 050426, International Search Report dated Nov. 26, 2015", 4 pgs.
"International Application Serial No. PCT US2015 050426, Written Opinion dated Nov. 26, 2015", 5 pgs.
"International Application Serial No. PCT US2015 050426, International Preliminary Report on Patentability dated Jun. 22, 2017", 7 pgs.
"U.S. Appl. No. 14/568,180, Preliminary Amendment filed Jan. 8, 2015", 7 pgs.
"U.S. Appl. No. 14/568,180, Non Final Office Action dated Jul. 28, 2017", 16 pgs.
"U.S. Appl. No. 14/568,180, Response filed Oct. 30, 2017 to Non Final Office Action dated Jul. 28, 2017", 13 pgs.
"U.S. Appl. No. 14/568,180, Final Office Action dated Feb. 23, 2018", 15 pgs.
"U.S. Appl. No. 14/568,180, Response filed May 23, 2018 to Final Office Action dated Feb. 23, 2018", 14 pgs.
"U.S. Appl. No. 14/568,180, Examiner Interview Summary dated Jun. 1, 2018", 3 pgs.
"U.S. Appl. No. 14/568,180, Non Final Office Action dated Sep. 18, 2018", 14 pgs.

(56) References Cited

OTHER PUBLICATIONS

"U.S. Appl. No. 14/568,180, Response filed Jan. 22, 2019 to Non Final Office Action dated Sep. 18, 2018", 9 pgs.
"Australian Application Serial No. 2015361241, Subsequent Examiners Report dated Jul. 30, 2019", 2 pgs.
"Chinese Application Serial No. 201510399124.6, Response filed Sep. 9, 2019 to Office Action dated Jun. 24, 2019", w current English claims, claims not amended in response, current claims from agent were added to reference PDF, 8 pgs.
"U.S. Appl. No. 14/568,180, PTO Response to Rule 312 Communication dated Oct. 16, 2019", 2 pgs.
"Australian Application Serial No. 2015361241, Response filed Jul. 23, 2019 to First Examination Report dated Jun. 28, 2019", 12 pgs.
"Australian Application Serial No. 2015361241, Response filed Oct. 1, 2019 to Subsequent Examiners Report dated Jul. 30, 2019", 1 pg.

* cited by examiner

CLEANING SYSTEM FOR AUTONOMOUS ROBOT

TECHNICAL FIELD

This invention relates to autonomous cleaning robots, such as those used for cleaning floors.

BACKGROUND

Autonomous floor-cleaning robots clean floor surfaces without direct and continuous human intervention and operation. Some clean by sweeping debris from the floor, and ingesting the debris as they travel. Some include vacuum systems that help to draw debris into the robot. Such robots may operate on hard floor surfaces, or on floor surfaces formed by carpeting or rugs. It is desired that such robots be able to clean as close to walls and other obstacles, and as far into corners, as possible.

SUMMARY

In one aspect of the invention, an autonomous cleaning robot includes a chassis, at least one motorized drive wheel mounted to the chassis and arranged to propel the robot across a surface, and a pair of cleaning rollers mounted to the chassis and having outer surfaces exposed on an underside of the chassis and to each other. The cleaning rollers are drivable to counter-rotate while the robot is propelled, thereby cooperating to direct raised debris upward into the robot between the rollers. A side brush is further mounted to the chassis to rotate beneath the chassis adjacent a lateral side of the chassis about an upwardly extending side brush axis. The outer surface of a first of the cleaning rollers of the pair extends laterally beyond the outer surface of a second of the cleaning rollers of the pair and laterally beyond the side brush axis, such that the first cleaning roller defines a cleaning width spanning the side brush axis. In other implementations, a motor is operably connected to the side brush and at least one of the cleaning rollers, such that operation of the motor turns the side brush and at least one of the cleaning rollers.

In some examples, the outer surface of the first of the cleaning rollers of the pair extends laterally beyond the outer surface of the second of the cleaning rollers by at least about one inch. A ratio of a length of the first of the cleaning rollers to a length of the second of the cleaning rollers may be between about 10:9 and 2:1, for example. In some cases, the first of the cleaning rollers of the pair includes two roller segments disposed to rotate about a common axis.

Some embodiments have first, second, and third sensors mounted to the chassis and responsive to radiation reflected upward from a floor surface beneath the sensors. The first sensor may be disposed near a front corner of the robot, the second sensor near a front portion of the robot near the side brush, and the third sensor on a near portion of the robot near the side brush, for example.

In some examples, the side brush includes a plurality of downwardly extending bristles arranged in a circular configuration that covers between 60% and 90% of the total perimeter of the circle.

The upwardly extending side brush axis may form an angle less than 90 degrees with the underside of the chassis.

In some implementations, the side brush includes multiple discrete bristle tufts arranged in a circular configuration, with bristle-free regions between the discrete bristle tufts. The bristle-free regions may be between 10% and 30% of the total perimeter of the circle defined by the circular configuration of discrete bristle tufts. In some cases a cliff sensor is mounted to the chassis and is responsive to radiation reflected upward from a floor surface beneath the cliff sensor. The side brush bristle tufts are configured to sweep through an area directly beneath the cliff sensor. In some cases the side brush is arranged such that during rotation of the side brush bristles of the side brush sweep under the outer surfaces of both cleaning rollers of the pair.

In some examples, at least one of the cleaning rollers includes or is a roller brush with a roller core and bristles extending from the core to define the outer surface of the roller brush. In some implementations, each of the cleaning rollers is or includes a roller brush. During counter-rotation of the cleaning rollers, bristles of the first cleaning roller may extend into space between bristles of the second cleaning roller brush. In other implementations, only one of the cleaning rollers is or includes a roller brush, while the other of the cleaning rollers is free of bristles.

In some examples, the outer surface of at least one of the rollers includes an elastomeric polymer. The elastomeric polymer may form exposed surfaces of raised features of the outer surface, for example. In some cases the elastomeric polymer is in the form of a sheath over a resilient layer.

In some implementations, the chassis has a forward outer edge segment that is linear. The forward outer edge segment is preferably generally parallel with the pair of cleaning rollers over at least a central 90% of the width of the chassis. The side brush may be arranged such that during rotation of the side brush bristles of the side brush sweep beyond the forward outer edge segment. The chassis may also have an outer side edge segment, on a side closest to the side brush, which is linear and generally perpendicular to the forward outer edge segment. The direction of rotation of the side brush may be chosen such that the time required for a portion of the side brush to sweep first under the lateral side and then under the forward outer edge segment is greater than the time required for the portion of the side brush to sweep first under the forward outer edge segment and then under the lateral side.

The first of the cleaning rollers of the pair preferably extends across at least 75% of an overall width of the cleaning robot.

The cleaning rollers together preferably cover a floor area at least 10% percent of a total floor area covered by the robot.

In most cases the cleaning rollers are configured to rotate about respective, parallel roller rotation axes. The upwardly extending side brush axis may be disposed forward of at least one of the roller rotation axes, with respect to a forward drive direction of the cleaning robot. In some examples a distance between the roller rotation axes is greater than half the sum of the diameters of the cleaning rollers. In some cases, at least one of the cleaning rollers of the pair is arranged to rotate around an axis disposed forward of the at least one motorized drive wheel, and preferably within a distance of a forward edge of the cleaning robot that is less than twice a diameter of the forward roller.

In most cases, the pair of rollers will have different lengths. Configuring the rollers such that one of the rollers in the pair (e.g., the rear roller in the direction of travel) extends beyond the axis of the side brush, can facilitate sweeping of debris by the side brush into the cleaning path of the robot, while maintaining an overall effective cleaning path width that is substantial with respect to an overall width of the robot. Debris encountered outside of the cleaning path defined by the pair of rollers can be effectively repositioned such that driving the robot forward allows the cleaning rollers to engage the debris for ingestion into the robot.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1A:
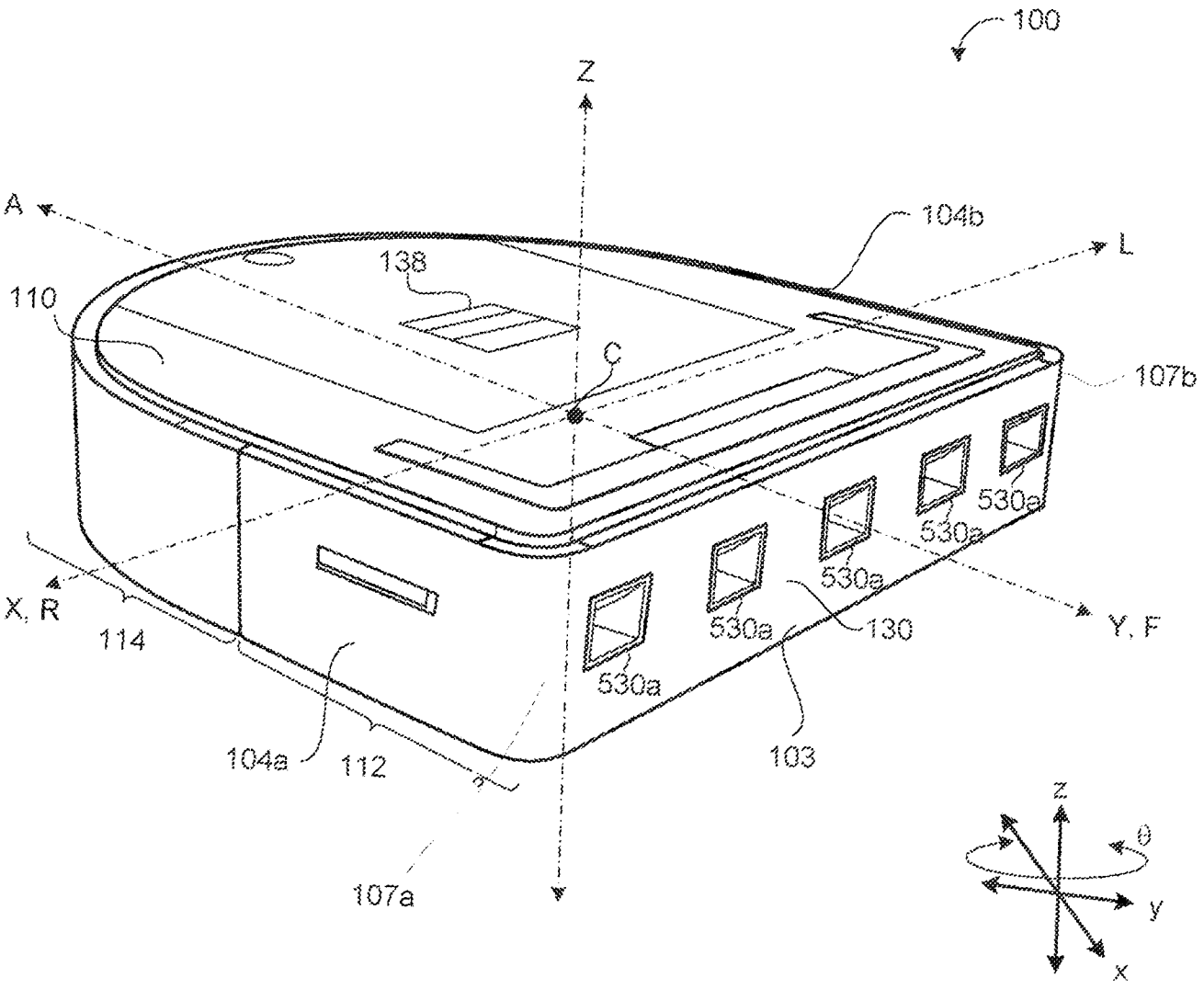
FIG. 1A is a perspective view of an exemplary cleaning robot.

An autonomous robot movably supported can clean a surface while traversing that surface. The robot can remove debris from the surface by agitating the debris and/or lifting the debris from the surface by applying a negative pressure (e.g., partial vacuum) above the surface, and collecting the debris from the surface. The robot can include a cleaning system of rollers and brushes that agitate debris and facilitate the intake of the debris. As will be described in detail below, the configuration of the rollers and brush(es) can be used to ensure that the robot can collect debris from corners and crevasses and places otherwise difficult to reach for the robot.

FIGS. 1-8, by way of general overview, pertain to an implementation of an autonomous cleaning robot 100. FIG. 1A-B shows perspective and bottom views, respectively, of the robot 100. Referring to FIG. 1A, robot 100 includes a body 110, a forward portion 112, and a rearward portion 114. The robot 100 can move across the floor surface through various combinations of movements relative to three mutually perpendicular axes defined by the body 110: a transverse axis X, a fore-aft axis Y, and a central vertical axis Z. A forward drive direction along the fore-aft axis Y is designated F (referred to hereinafter as "forward"), and an aft drive direction along the fore-aft axis Y is designated A (referred to hereinafter as "rearward"). The transverse axis X extends between a right side R and a left side L of the robot 100 substantially along an axis defined by center points of, referring briefly to FIG. 1B, the wheel modules 120*a*, 120*b*. The forward portion 112 has a front surface 103 that is generally perpendicular to side surfaces 104*a*-*b* of the robot 100. Referring briefly to both FIGS. 1A and 1B, rounded surfaces 107*a*-*b* connect the front surface 103 to the side surfaces 104*a*-*b*. The front surface 103 is at least 90% of the width of the robot body. The rearward portion 114 is generally rounded, having a semicircular cross section. A user interface 140 disposed on a top portion of the body 110 receives one or more user commands and/or displays a status of the robot 100. Sonar sensors 530*a* disposed on the forward portion 112 serve as transducers of ultrasonic signals to evaluate the distance of obstacles to the robot 100. The forward portion 112 of the body 110 further carries a bumper 130, which detects (e.g., via one or more sensors) obstacles in a drive path of the robot 100. For example, now referring to FIG. 1B, which shows a bottom view of the robot 100, as the wheel modules 120*a*, 120*b* propel the robot 100 across the floor surface during a cleaning routine, the robot 100 may respond to events (e.g. collision with obstacles, walls) detected by the bumper 130 by controlling the wheel modules 120*a*, 120*b* to maneuver the robot 100 in response to the event (e.g., away from an obstacle).

Figure 1B:
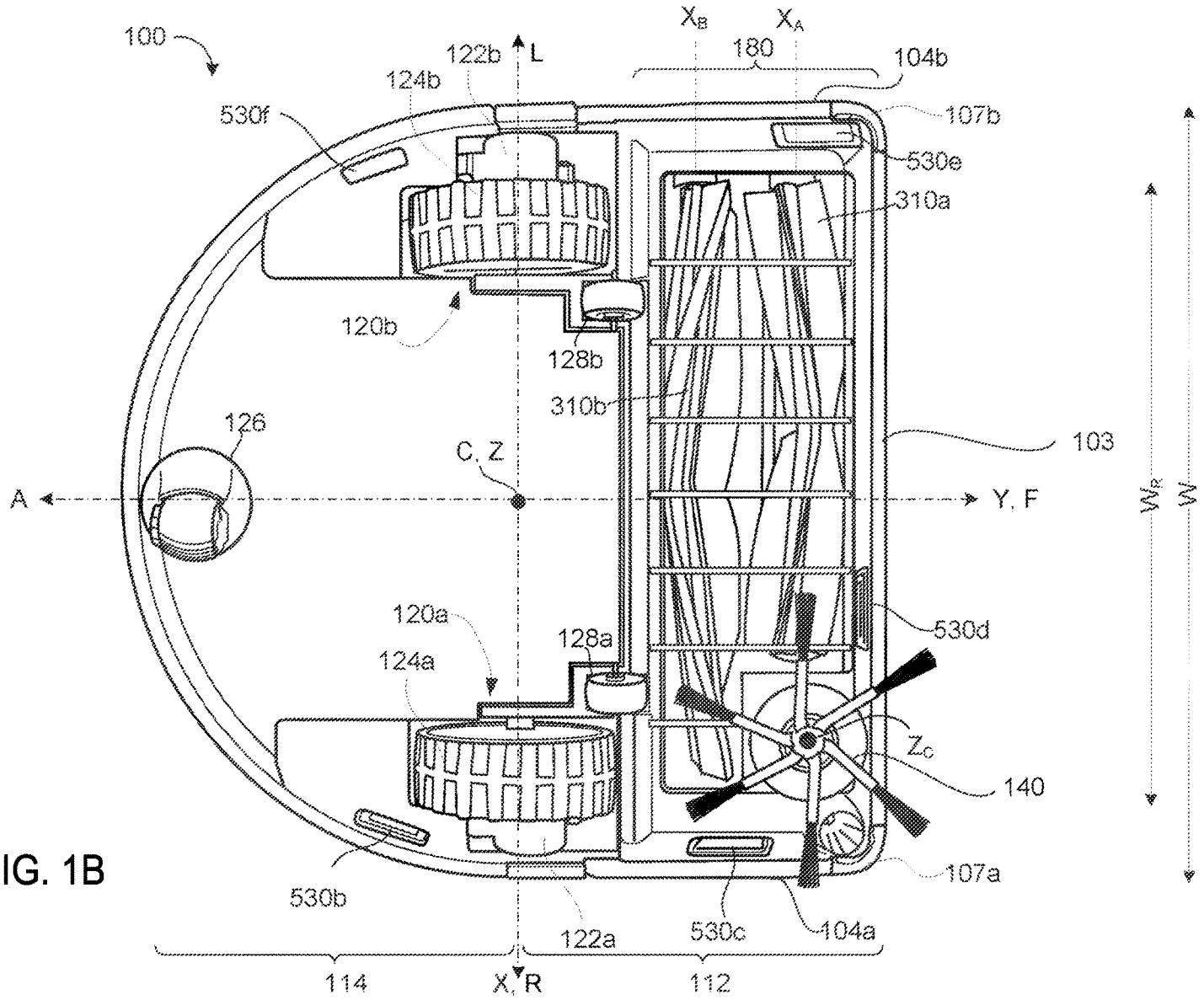
FIG. 1B is bottom view of the robot shown in FIG. 1A.
Figure 2:
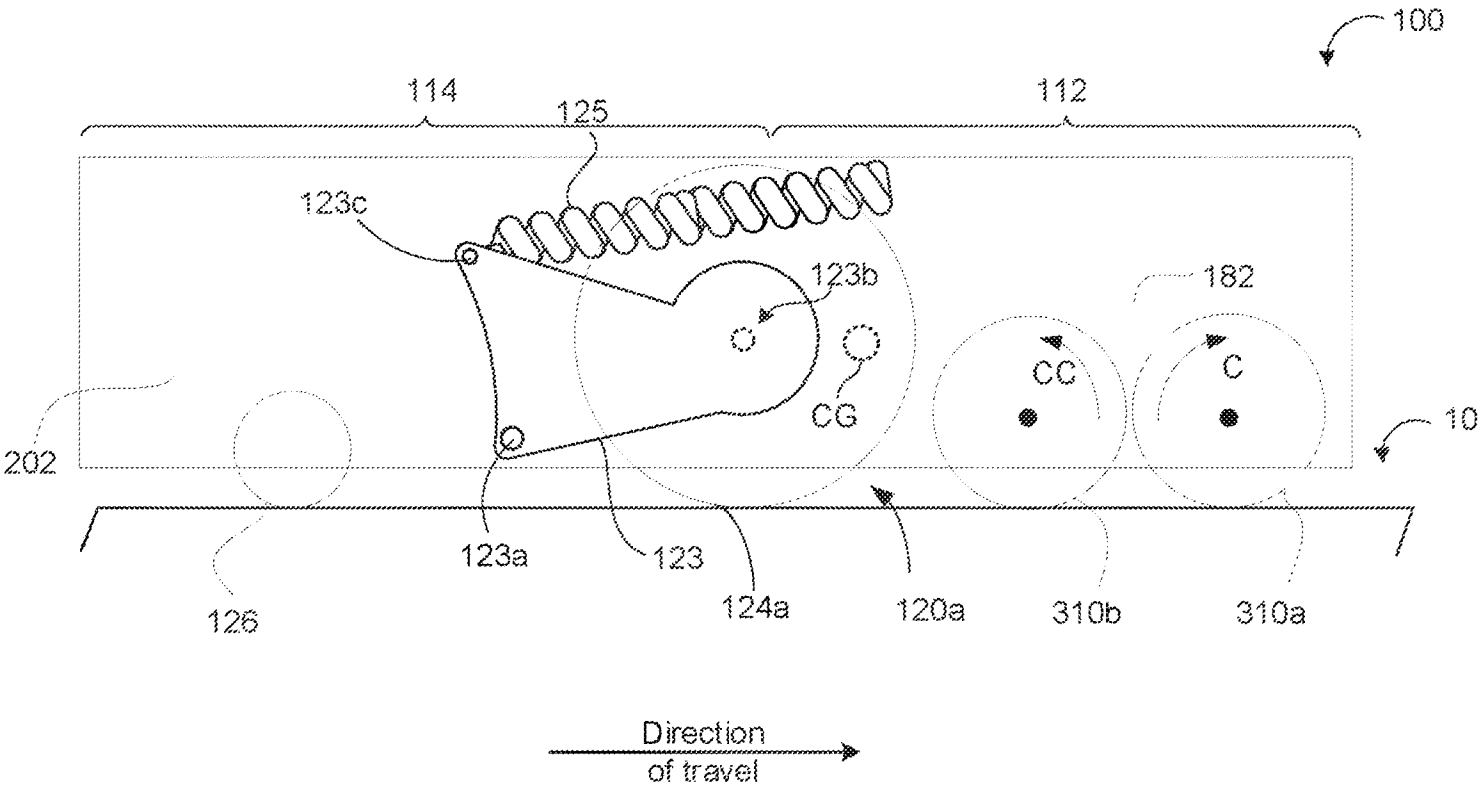
FIG. 2 is a simplified schematic side view of the robot shown in FIG. 1A.

Still referring to FIG. 1B, the bottom surface of the forward portion 112 of the robot 100 further includes a cleaning head 180, a side brush 140, wheel modules 120*a*-*b*, a caster wheel 126, clearance regulators 128*a*-*b*, and cliff sensors 530*b*. The cleaning head 180, disposed on the forward portion 112, receives a front roller 310*a* which rotates about an axis $X_A$ and a rear roller 310*b* which rotates about an axis $X_B$. Both axes $X_A$ and $X_B$ are substantially parallel to the axis X. Referring briefly to FIG. 2, the front roller 310*a* and rear roller 310*b* rotate in opposite directions. More particularly, the rear roller 310*b* rotates in a counter-clockwise sense CC, and the front roller 310*a* rotates in a clockwise sense C. Referring back to FIG. 1B, the rollers 310*a*-*b* are releasably attached to the cleaning head 180. The robot body 110 includes the side brush 140 disposed on the bottom forward portion 112 of the robot body 110. The side brush 140 axis $Z_C$ is offset along the axes X and Y of the robot such that it sits on a lateral side of the forward portion 112 of the body 110. The side brush 140, in use, rotates and sweeps an area directly beneath one of the cliff sensors 530*b*. The front roller 310*a* and the rear roller 310*b* cooperate with the side brush 140 to ingest debris, a process that will be discussed in more detail later. The side brush axis $Z_C$ is disposed forward of both the front roller axis $X_A$ and the rear roller axis $X_B$.

Wheel modules 120*a*, 120*b* are substantially opposed along the transverse axis X and include respective drive motors 122*a*, 122*b* driving respective wheels 124*a*, 124*b*. Forward drive of the wheel modules 120*a*-*b* generally induces a motion of the robot 100 in the forward direction F, while back drive of the wheel modules 120 generally produces a motion of the robot 100 in the rearward direction A. The drive motors 122*a-b* are releasably connected to the body 110 (e.g., via fasteners or tool-less connections) with the drive motors 122*a-b* positioned substantially over the respective wheels 124*a-b*. The wheel modules 120*a-b* are releasably attached to the body 110 and forced into engagement with the floor surface by respective springs 125 (shown in FIG. 2). The spring biasing, which will be shown and described later, allows the drive wheels 124*a-b* to maintain contact and traction with the floor surface while cleaning elements (e.g. the rollers 310*a-b*) of the robot 100 contact the floor surface as well.

The robot 100 further includes a caster wheel 126 disposed to support a rearward portion 114 of the robot body 110. The caster wheel 126 swivels and is vertically spring-loaded to bias the caster wheel 126 to maintain contact with the floor surface. The caster wheel 126 rides on a hard stop while the robot 100 is mobile. A sensor in the caster wheel 126 detects if the robot 100 is no longer in contact with a floor surface (e.g. when the robot 100 backs up off a stair allowing the vertically spring-loaded swivel caster 126 to drop). The caster wheel 126 additionally keeps the rearward portion 114 of the robot body 110 off the floor surface and prevents the robot 100 from scraping the floor surface as it traverses the floor or as the robot 100 climbs obstacles. The spring biasing of the caster wheel 126 allows for a tolerance in the location of the center of gravity CG (shown in FIG. 2) of the robot 100 to maintain contact between the rollers 310*a-b* and the floor 10. The robot 100 weighs between about 10 and 60 N empty. The robot 100 has most of its weight over the drive wheels 124*a-b* to ensure good traction and mobility on surfaces. The caster 126 disposed on the rearward portion 114 of the robot body 110 can support between about 0-25% of the robot's weight.

The clearance regulators 128*a-b*, rotatably supported by the robot body 110 adjacent to and forward of the drive wheels 124*a-b*, are rollers that maintain a minimum clearance height (e.g., at least 2 mm) between the bottom surface of the body 110 and the floor surface. The clearance regulators 128*a-b* support between about 0-25% of the robot's weight and ensure the forward portion 112 of the robot 100 does not sit on the ground when the robot 100 accelerates.

The robot 100 includes multiple cliff sensors 530*b-f* located near the forward and rear edges of the robot body 110. Cliff sensors 530*c*, 530*d*, and 530*e* are located on the forward portion 112 near the front surface 103 of the robot and cliff sensors 530*b* and 530*f* are located on a rearward portion 114. Each cliff sensor is disposed near one of the side surfaces so that the robot 100 can detect an incoming drop or cliff from either side of its body 110. Each cliff sensor 530*b-f* emits radiation, e.g. infrared light, and detects a reflection of the radiation to determine the distance from the cliff sensor 530*b-f* to the surface below the cliff sensor 530*b-f*. A distance larger than the expected clearance between the floor and the cliff sensor 530*b-f*, e.g. greater than 2 mm, indicates that the cliff sensor 530*b-f* has detected a cliff-like feature in the floor topography.

The cliff sensors 530*c*, 530*d*, and 530*c* located on the forward portion 112 of the robot are positioned to detect an incoming drop or cliff from either side of its body 110 as the robot moves in the forward direction F or as the robot turns. Thus, the cliff sensors 530*c*, 530*d*, and 530*e* are positioned near the front right and front left corners (e.g., near the rounded surfaces 107*a-b* connect the front surface 103 to the side surfaces 104*a-b*). Cliff sensor 530*e* is positioned within about 1-5 mm of the rounded surface 107*b*. Due to the location of the side brush at the corner of the robot, a cliff sensor cannot be placed at the same location on the opposite side of the robot near rounded surface 107*a*. In order to still capture potential cliffs near the front (e.g., when the robot 100 is moving in the forward direction F) or the side (e.g., when the robot is turning), the robot includes a pair of cliff sensors positioned near the corner adjacent to the side brush 140. A first cliff sensor 530*d* is located along the front edge 103 of the robot and a second cliff sensor 530*c* is located along the right side of the robot. Cliff sensors 530*c* and 530*d* are each positioned between least 10 mm and 40 mm from the corner of the robot 100 (e.g., rounded surface 107*a*). The cliff sensors 530*c* and 530*d* are positioned near the side brush 140 such that the side brush 140, in use, rotates and sweeps an area directly beneath cliff sensors 530*c* and 530*d*.

Figure 1C:
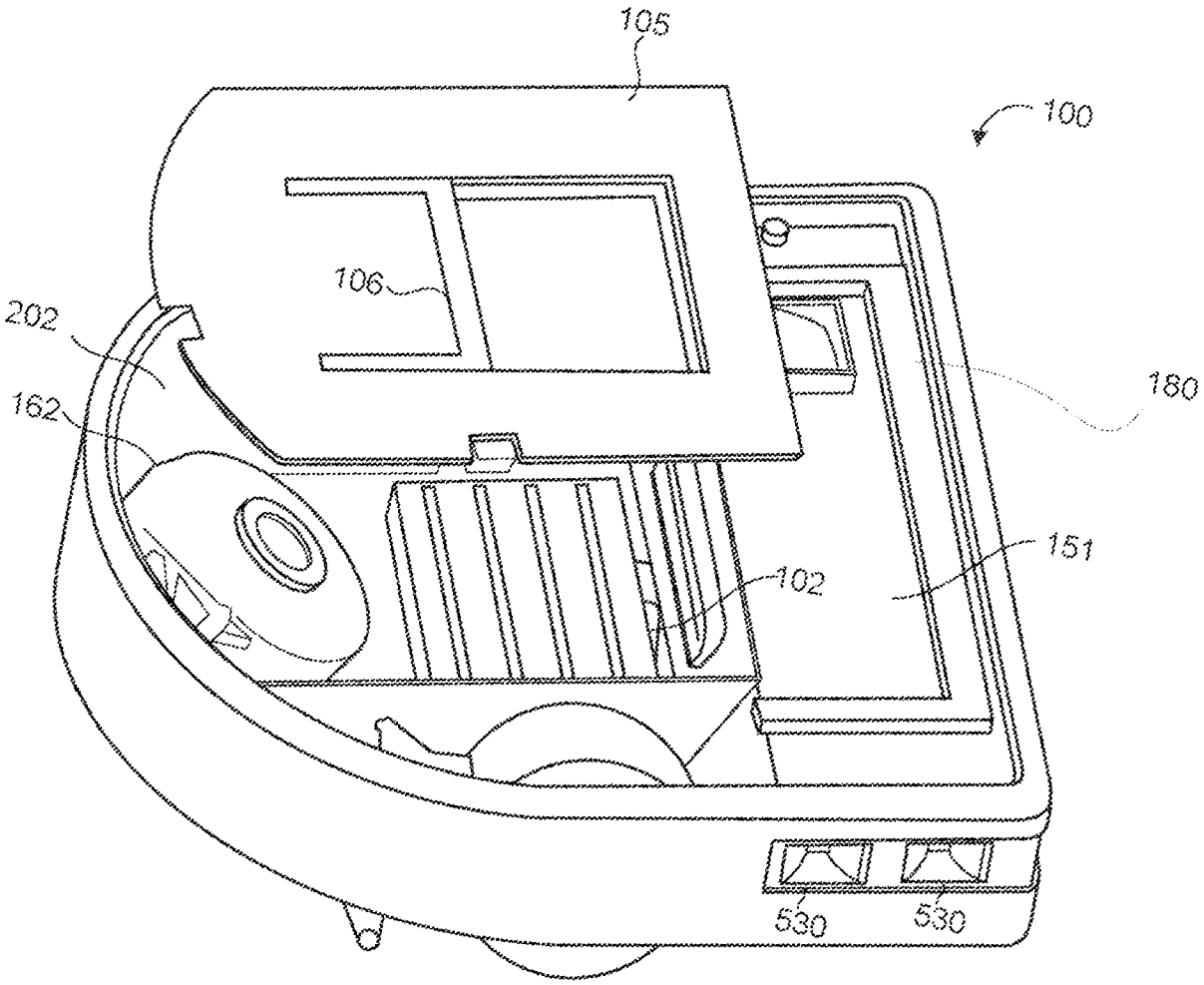
FIG. 1C is a perspective view of the robot shown in FIG. 1A with a removable top cover detached from the robot.

FIG. 1C shows a perspective view of the robot 100 with a removable top cover 105 removed. Referring FIG. 1C, the robot body 110 supports a power source 102 (e.g., a battery) for powering any electrical components of the robot 100, and a vacuum module 162 for generating vacuum airflow to deposit debris into a dust bin (not shown). Referring briefly to FIG. 2, the location of a plenum 182 and the dust bin 202 are generally shown. The plenum 182 is a chamber above the rollers 310 in the cleaning head 180, and the dust bin 202 sits in the rearward portion 114 of the robot. A conduit (not shown) connects the plenum 182 with the dust bin 202. The vacuum module 162 includes an impeller (not shown) driven by a motor to produce the airflow from the plenum 182 into the dust bin 202. Referring back to FIG. 1C, a handle 106 can be used to release the removable top cover to provide access to the dust bin. Releasing the removable top cover also allows access to a release mechanism for the cleaning head 180, which is releasably connected to the robot body 110. A user can remove the dust bin 202 and/or the cleaning head 180 to clean any accumulated dirt or debris. Rather than requiring significant disassembly of the robot 100 for cleaning, a user can remove the cleaning head 180 (e.g., by releasing tool-less connectors or fasteners) and empty the dust bin 202 by grabbing and pulling the handle 106. The robot 100 further supports a robot controller 151, which will be described in more detail later. Generally, the controller 151 operates electromechanical components of the robot 100, such as the user interface 140, the wheel modules 120*a-b*, and the sensors 530 (shown in FIGS. 1A-B).

The vacuum module, dust bin, and cleaning head disclosed and illustrated herein may include, for example, vacuum systems, dust bins, and cleaning heads as disclosed in U.S. patent application Ser. No. 13/460,261, filed Apr. 30, 2012, titled "Robotic Vacuum," the disclosure of which is incorporated by reference herein in its entirety.

FIG. 2, a simplified schematic side view of the robot 100, depicts an example of a drive wheel suspension system described above. Although only the wheel module 120*a* is schematically shown, it should be understood a similar suspension system is used for wheel module 120*b*. The wheel modules 120*a* are pinned to the robot body 110 and receive spring biasing, for example, between about 5 and 25 Newtons, that biases the drive wheel 124*a* downward and away from the robot body 110. Referring to FIG. 2, the drive wheel 124*a* is supported by a drive wheel suspension arm 123. The drive wheel suspension arm 123 is a bracket having a pivot point 123*a*, a wheel pivot point 123*b*, and spring anchor point 123*c* spaced from the pivot point 123*a* and the wheel pivot 123*b*. The pivot point 123*a* is pinned to the robot body 110, and the wheel pivot point 123*b* rotatably supports the drive wheel 124*a*. A drive wheel suspension spring 125 attached to a third end 123*b* biases the drive wheel 124*a* toward the floor surface 10. The spring 125 generates a force at the spring anchor 123*b*, causing the suspension arm 123 to rotate about the pivot point 123*a* to move the drive wheel 124*a* toward the floor surface 10. For example, the drive wheel 124*a* can receive a downward bias of about 10 Newtons when moved to a deployed position and about 20 Newtons when moved to a retracted position into the robot body 110.

The center of gravity CG of the robot 100 is located forward of the drive axis (0-35%) to help maintain the forward portion 112 of the body 110 downward, causing engagement of the rollers 310*a-b* with the floor. For example, the center of gravity placement allows the robot body 110 to pivot forwards about the drive wheels 124*a*, 124*b*.

Figure 3:
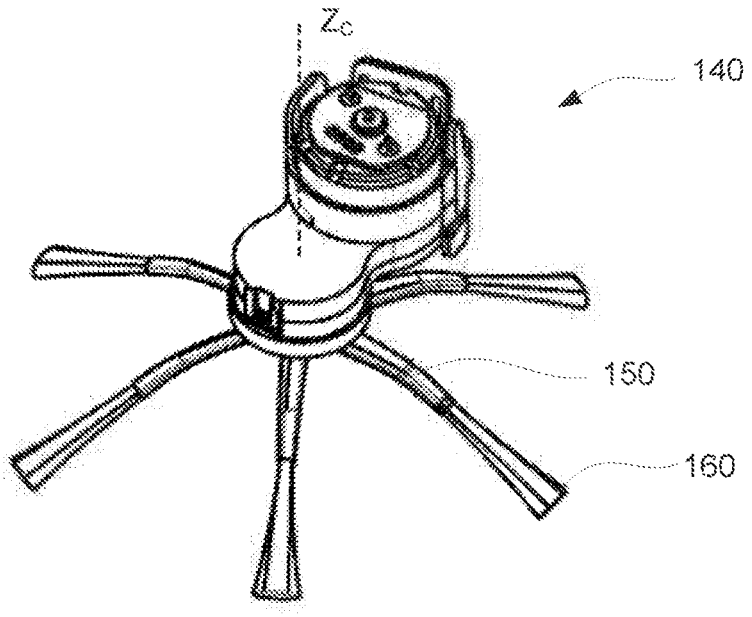
FIG. 3 is a perspective view of a side brush of the robot of FIG. 1A.

FIG. 3 depicts the structure of the side brush 140. The side brush 140 agitates debris on the floor surface, moving the debris into the forward cleaning path of the vacuum module 162 (shown in FIG. 1C). The side brush 140 extends beyond the robot body 110 (e.g. extends beyond, referring briefly to FIG. 1A, the side surface 104 and the front surface 103 of the robot body 110) allowing the side brush 140 to agitate debris in hard to reach areas such as corners and around furniture so that the rollers can ingest the debris. The side brush 140 rotates about an axis $Z_C$ through which a side brush axle (not shown) spans. The side brush 140 further includes struts 150 that extend from near the free end of the axle and bristle tufts 160 attached to the free ends of each strut. The bristles 160 are fibrous and can be made of synthetic or natural fibers, such as nylon or animal hair. While the robot body 110 is on the floor surface 10, the axis $Z_C$ is oriented such that it forms a non-perpendicular angle with the plane that defines the floor surface 10 and a non-perpendicular angle with the bottom surface of the robot. The angle formed with the bottom surface of the robot is less than 90 degrees. The axle 145 attaches directly to a motor disposed in the robot body 110. The struts 150 are evenly spaced about the axis $Z_C$, are generally axisymmetric about the axis $Z_C$, and each extends about 1 to 2 inches from the axis $Z_C$. The struts 150 are made of a flexible material, such as an elastomer, so that they deform when they make contact with hard surfaces and obstacles. As shown, the three flexible struts 150A-C are spaced 60 degrees from one another. The bristle tufts 160 have substantially the same length and coverage. The bristle tufts 160, arranged in a circle defined by the extension of the struts 150 from the axle 145, cover between 10% and 30% of the total perimeter of the circle.

Figure 4A:
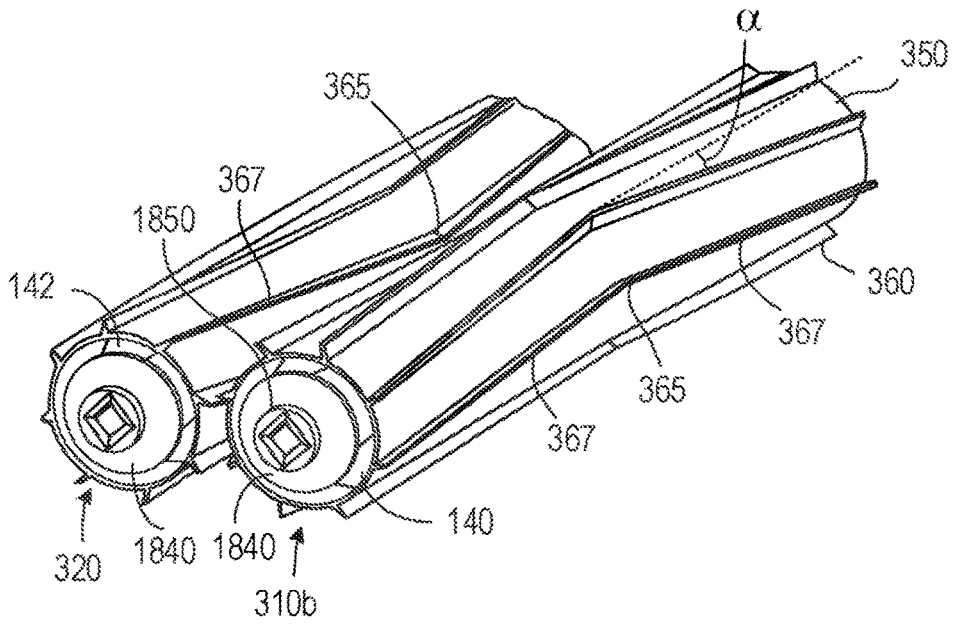
FIG. 4A is a perspective view of rollers of the robot depicted in FIG. 1B.
Figure 4B:
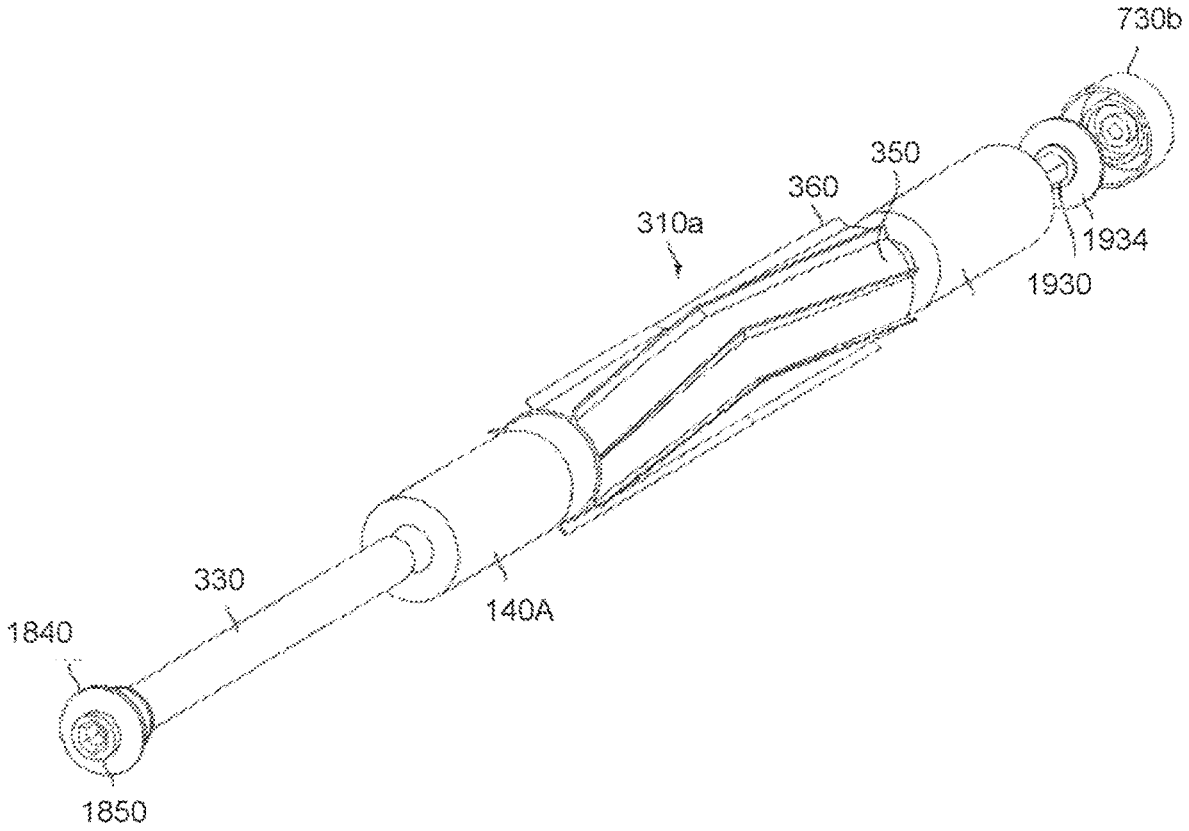
FIG. 4B is an exploded perspective view of one of the rollers of FIG. 4A.
Figure 4C:
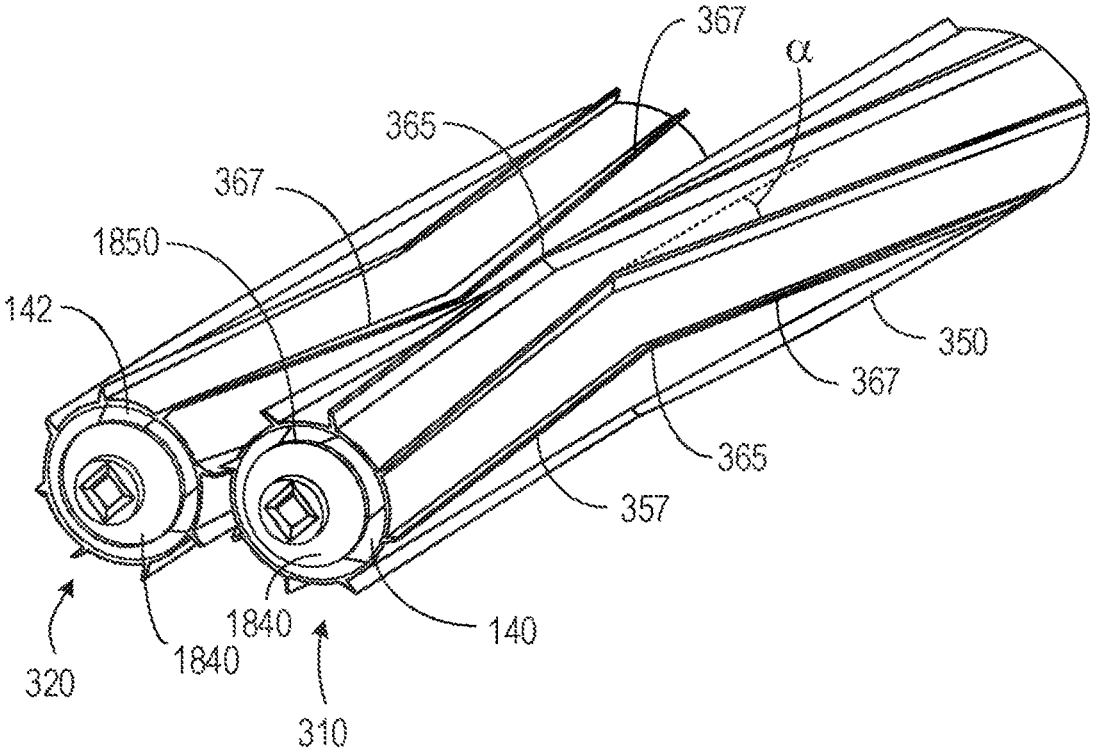
FIG. 4C is a perspective view of rollers of the robot depicted in FIG. 1B.

FIGS. 4A, 4B, and 4C pertain to the structure of the rollers 310*a-b* shown in FIG. 1B. FIGS. 4A and 4C illustrate exemplary facing rollers 310*a-b* with spaced chevron vanes 360. Roller 310*a* and roller 310*b* differ in length but are structurally similar. The length of the rear roller 310*a* is about 7 inches, and the length of the front roller is about 6 inches. Each roller 310*a-b* includes flanges 1840 and 1850 of an axle 330 and a foam core 140 supporting a tube 350. The tube 350 forms the outer surface of each roller and is of a high-friction material such as an elastomer, so as to better grip incoming debris and to allow for deformation. For example, the tube 350 can be manufactured from thermoplastic polyurethane (TPU). In one implementation, the wall of the tube 350 has a thickness of about 1 mm, an inner diameter of about 23 mm, and an outer diameter of about 25 mm. The vanes 360 of the elastomeric polymer tube 350 are raised features of the outer surface of the tube 350. The outer diameter of the outside circumference swept by the tips of the vanes 360 is about 30 mm.

Still referring to FIGS. 4A and 4C, the rollers 310 face each other such that the chevron-shaped vanes 360 on the tube 350 are mirror images. Each chevron-shaped vane of the illustrated rollers include a central point 365 and two sides or legs 367 extending downwardly therefrom on the front roller 310*a* and upwardly therefrom on the rear roller 310*b*. The two legs of the V-shaped chevron are at an angle of 7°. A chevron shape of the vanes 360 draws hair and debris away from the sides of the rollers and toward a center of the rollers to further prevent hair and debris from migrating toward the roller ends where they can interfere with operation of the robotic vacuum. The vanes 360 are integrally formed with the tube 350 and define V-shaped chevrons extending from one end of the tube 350 to the other end. The chevron vanes 360 are equidistantly spaced around the circumference of the tube 350. The vanes 360 are aligned such that the ends of one chevron are coplanar with the central point 365 of an adjacent chevron so as to provide constant contact between the chevron vanes 360 and a contact surface with which the compressible roller 310 engages. Such uninterrupted contact eliminates noise otherwise created by varying between contact and no contact conditions. The chevron vanes 360 extend from the outer surface of the tube 350 at an angle $\alpha$ of about, for example, 45° relative to a radial axis of the roller 310 and inclined toward the direction of rotation.

As noted above, the rollers 310 face each other such that the chevron-shaped vanes 360 on the tube 350 are mirror images. In the example of FIG. 4A, the chevron-shaped vanes of the longer roller (e.g., roller 310*b*) are symmetrical about the central point 365 such that the length of the legs 367 extending to the right from the central point 365 have substantially the same length as the legs 367 extending to the left from the central point 365. In order for the shorter roller (e.g., the front roller 310*a*) to form a mirror image of the chevron-shape, the roller 310*a* is not symmetrical about the central point 365. Rather, the legs 367 extending to the right from the central point 365 have a different length than the legs 367 extending to the left from the central point 365. The legs 367 of roller 310*a* extending toward the side brush 140 are shorter than the legs 367 extending toward the side of the robot 310 without the side brush. In the example of FIG. 4C, the chevron-shaped vanes of the shorter roller (e.g., roller 310*a*) are symmetrical about the central point 365 such that the length of the legs 367 extending to the right from the central point 365 have substantially the same length as the legs 367 extending to the left from the central point 365. In order for the longer roller (e.g., the roller 310*b*) to form a mirror image of the chevron-shape, the roller 310*b* is not symmetrical about the central point 365. Rather, the legs 367 extending to the right from the central point 365 have a different length than the legs 367 extending to the left from the central point 365. The legs 367 of roller 310*b* extending toward the side brush 140 are longer than the legs 367 extending toward the side of the robot 310 without the side brush.

FIG. 4B illustrates a side perspective exploded view of a roller, such as roller 310*a* of FIG. 4A. The axle 330 is shown, along with the flanges 1840 and 1850 of its driven end. The axle insert 1930 and flange 1934 of the non-driven end are also shown, along with the shroud 730*b* of the non-driven end. Two foam inserts 140*a-b* fit into the tube 350 to make up the collapsible, resilient foam core 140 for the tube 350. The foam core 140 is resilient such that when the foam core 140 experiences a force that causes a deformation, upon removal of the force, the foam core 140 rebounds to its undeformed state. As shown, the tube 350 forms a sheath that encompasses the foam core 140. Because the chevron vanes 360 extend from the outer surface of the tube 350 (e.g. by a height at least 10% of the diameter of the resilient tubular roller), they further prevent cord like elements from directly wrapping around the outer surface of the tube 350. The vanes 360 therefore prevent hair or other string like debris from wrapping tightly around the foam inserts 140 of the roller 310 and reducing efficacy of cleaning.

The cleaning system includes a collection volume disposed on the robot body (e.g., the bin), a plenum arranged over the first and second roller brushes, and a conduit in pneumatic communication with the plenum and the collection volume. In some examples, the cleaning head 180 defines a recess having an L-shape for receiving the different length roller brushes 310*a* and 310*b*. The recess allows the rollers 310*a* and 310*b* to be in contact with a floor surface 10 for cleaning.

Figure 5A:
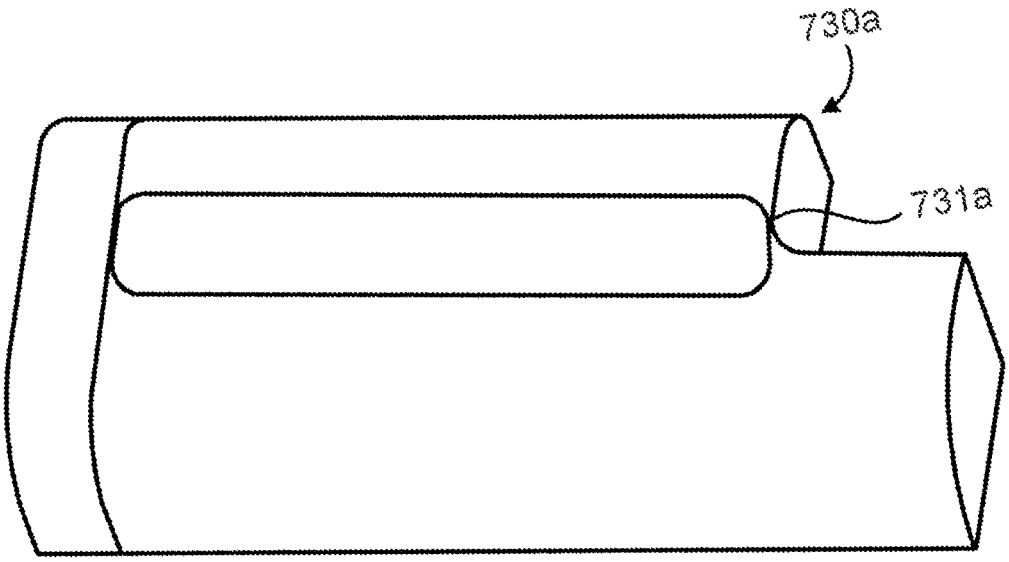
FIGS. 5A and 5B are perspective views of a portion of the robot chassis forming a shroud surrounding the rollers depicted in FIG. 4A.
Figure 5B:
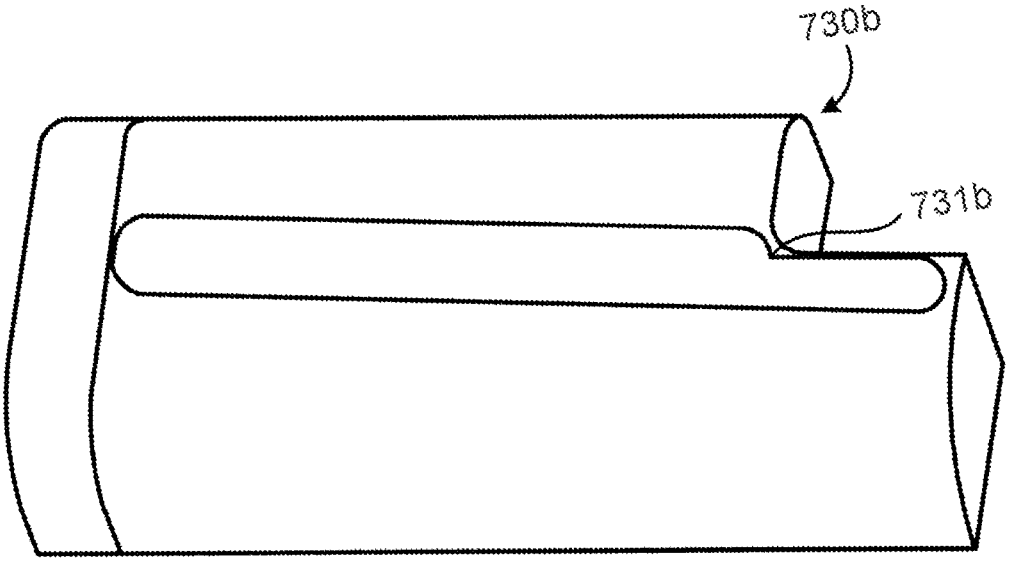

Referring to FIGS. 5A-B, the cleaning head 180 includes a plenum 730*a*, 730*b* arranged over the rollers 310*a* and 310*b*. A conduit or ducting 731*a*, 731*b* provides pneumatic communication between the plenum 730*a*, 730*b* and the collection volume. The plenum 730*a*, 730*b* cooperates with the rollers 310*a-b* to allow the vacuum module 162 to focus air flow through an air gap G of 1 mm or less. The conduit or ducting 731*a*, 731*b* is aligned with the small gap G exists between rollers 310*a* and 310*b* such that the center of the conduit or ducting 731*a*, 731*b* lies directly above the gap G. The plenum 730*a*, 730*b* can be formed of a unitary piece of molded plastic. Additionally, the shape of the plenum 730*a*, 730*b* can be configured to provide minimal spacing (e.g., 1 mm or less) between the edge of the rollers and the surface of the plenum 730*a*, 730*b* to concentrate the airflow between the rollers.

The shape of the conduit or ducting 731*a*, 731*b* that provides the pneumatic communication between the plenum 730*a*, 730*b* and the collection volume can vary based on the desired airflow characteristics. In one example, as shown in FIG. 5A, the conduit or ducting 731*a* extends along the length of the shorter of the two rollers 310*a*. In this example, the conduit or ducting 731*a* does not extend along the portion of the longer roller 310*b* adjacent to the side brush 140. By including the conduit or ducting 731*a* only in the region where the two rollers 310*a* and 310*b* are opposing one another, the airflow is concentrated between the rollers. While there is not a conduit adjacent to the additional portion of the longer roller 310*b* (e.g., the portion adjacent to the side brush), debris collected by the longer roller 310*b* in this region is directed toward the conduit or ducting 731*a* by the chevron shape of the roller and a sloped portion of the shroud. Thus, the entire length of the longer roller aids in the collection of debris even in the absence of a conduit or ducting 731*a* directly above the roller. In another example, as shown in FIG. 5B, the conduit or ducting 731*b* extends along the length of both the shorter rollers 310*a* and the longer roller 310*b*. In this example, the conduit or ducting 731*b* has a different width in the area between the two rollers 310*a* and 310*b* than in the area adjacent to the additional portion of the longer roller 310*b* (e.g., the portion adjacent to the side brush). The smaller opening of the portion of the conduit or ducting 731*b* helps to prevent air loss. By including the conduit or ducting 731*b* along the entire length of both of the rollers, airflow can aid in debris collection along the entire length of the rollers.

Figure 5C:
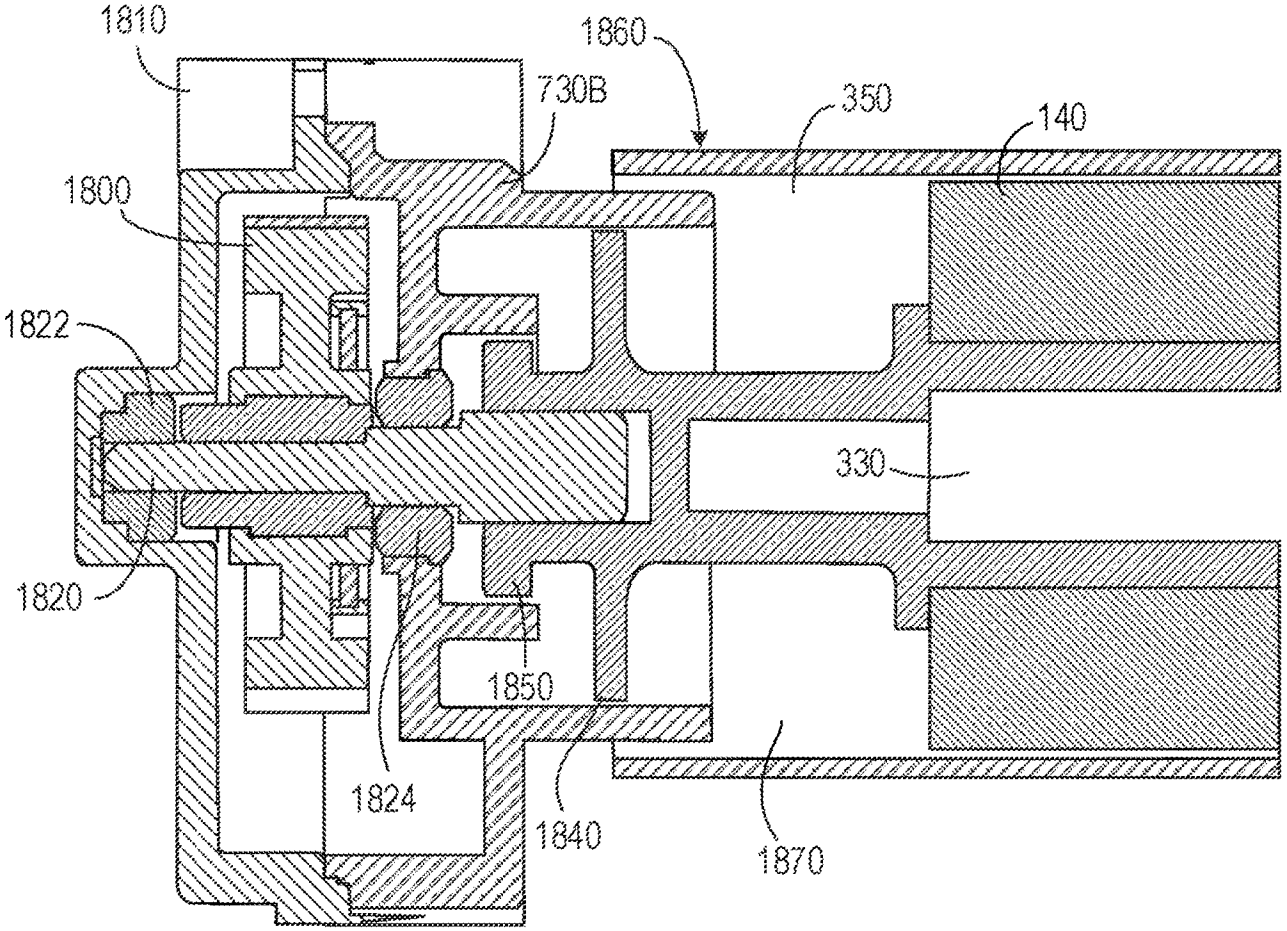
FIG. 5C is a side cross-sectional view of the driven end of one of the rollers depicted in FIG. 4A.

FIG. 5C is a cross sectional view of an exemplary driven end of an embodiment of a cleaning head roller 310. The drivetrain, which will be described in more detail later, includes the rear roller gearbox 450*a* and the front roller gearbox 450*b*. The drivetrain is shown in the gearbox housing 1810, along with a roller drive shaft 1820 and two bushings 1822, 1824. The roller drive shaft 1820 can have, for example, a square cross section or a hexagonal cross section as would be appreciate by those skilled in the art. A shroud 730*a* is shown to extend from within the roller tube 350 to contact the gearbox housing 1810 and the bearing 1824 and can prevent hair and debris from reaching the gear 1800. The axle 330 of the roller engages the roller drive shaft 1820. In the illustrated embodiment, the area of the axle 330 surrounding the drive shaft 1800 includes a larger flange or guard 1840 and a smaller flange or guard 1850 spaced outwardly therefrom. The flanges/guards 1840, 1850 cooperate with the shroud 1830 to prevent hair and other debris from migrating toward the gear 1800. An exemplary tube overlap region 1860 is shown, where the tube 350 overlaps the shroud 730*a*. The flanges and overlapping portions of the driven end shown in FIG. 5C can create a labyrinth-type seal to prevent movement of hair and debris toward the gear. In certain embodiments, hair and debris that manages to enter the roller despite the shroud overlap region 1860 can gather within a hair well or hollow pocket 1870 that can collect hair and debris in a manner that substantially prevents the hair and debris from interfering with operation of the cleaning head. Another hair well or hollow pocket can be defined by the larger flange 1840 and the shroud 730*a*. The axle and a surrounding collapsible core preferably extend from a hair well on this driven end of the roller to a hair well or other shroud-type structure on the other non-driven end of the roller.

Figure 5D:
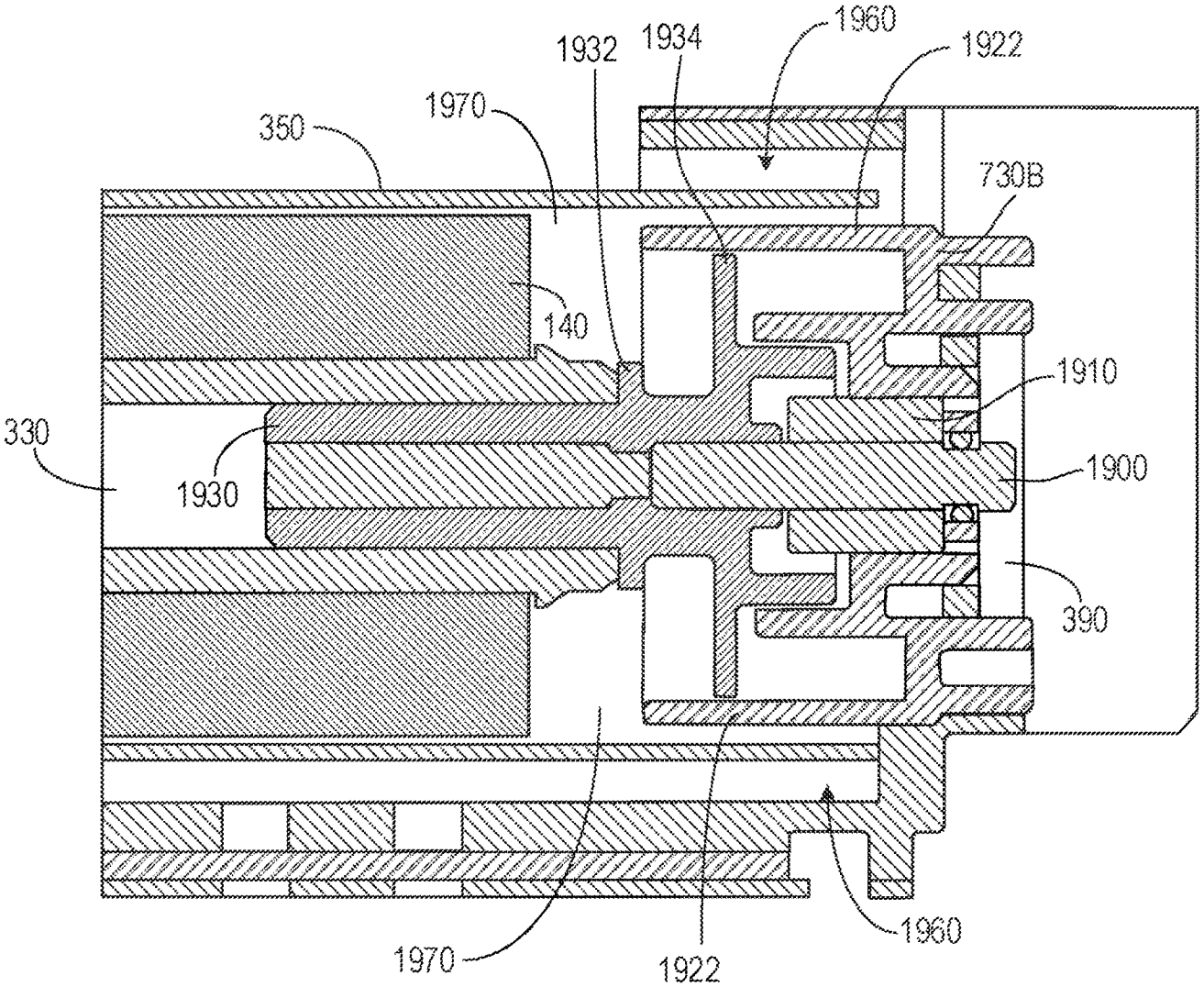
FIG. 5D is a side cross-sectional view of the non-driven end of one of the rollers depicted in FIG. 4A.

FIG. 5D is a cross sectional view of an exemplary non-driven end of an embodiment of a roller 310. A pin 1900 and bushing 1910 of the non-driven end of the roller are shown seated in the cleaning head lower housing 390. A shroud extends from the bushing housing 1920 into the roller tube 350, for example with legs 1922, to surround the pin 1900 and bushing 1910, as well as an axle insert 1930 having a smaller flange or guard 1932 and a larger flange or guard 1934, the larger flange 1934 extending outwardly to almost contact an inner surface of the shroud 1920. An exemplary tube overlap region 1960 is shown, where the tube 350 overlaps the shroud 730*b*. The flanges/guards and overlapping portions of the drive end shown in FIG. 7D create a labyrinth-type seal to prevent movement of hair and debris toward the gear. The shroud is preferably shaped to prevent entry of hair into an interior of the roller and migration of hair to an area of the pin. Hair and debris that manages to enter the roller despite the shroud overlap region 1960 gathers within a hair well or hollow pocket 1970 that can collect hair and debris in a manner that substantially prevents the hair and debris from interfering with operation of the cleaning head. Another hair well or hollow pocket is defined by the larger flange 1934 and the shroud 730*b*.

Figure 6A:
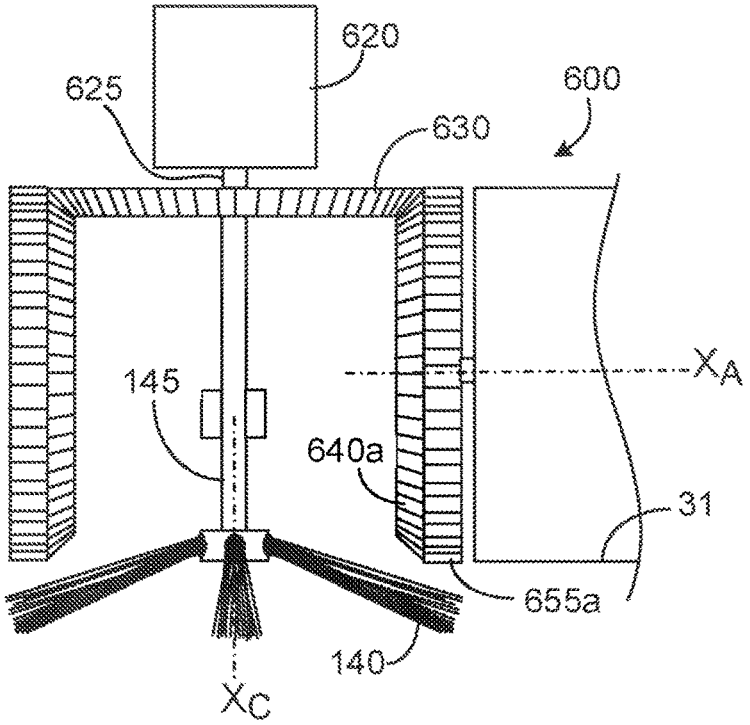
FIG. 6 is an example of a drivetrain of the robot.
Figure 6B:
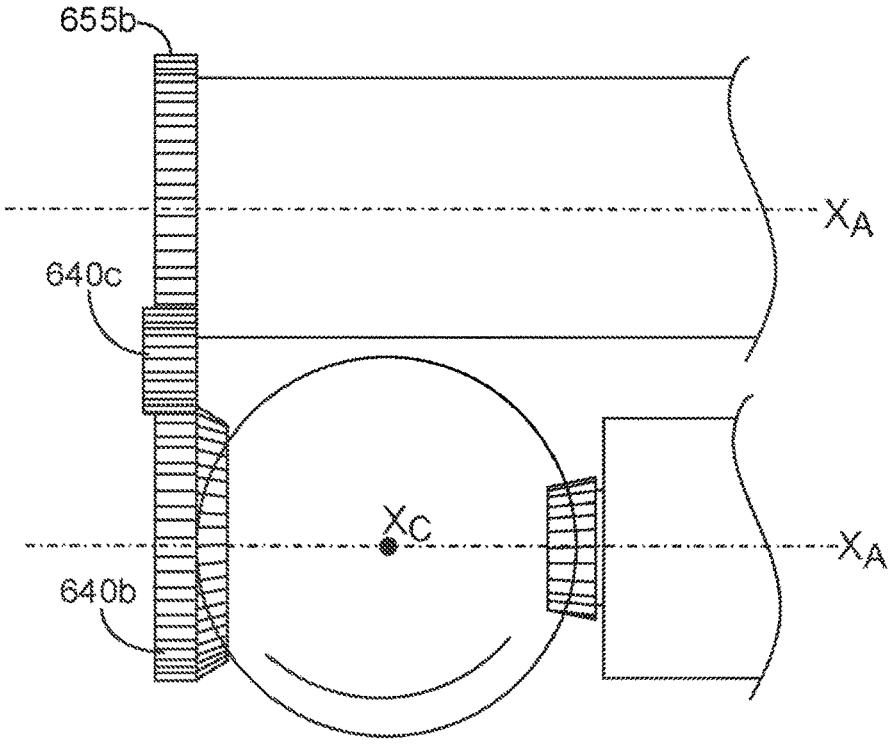

Referring to FIG. 6A-B illustrate front and bottom perspectives, respectively, of an exemplary drivetrain 600 for driving the side brush 140, the rear roller 310*b*, and the front roller 310*a* such that the rollers 310*a-b* are rotating counter to another. A motor 620 can directly drive the side brush 140. The gear ratio for the gear train from the motor 620 to the axle driving the rear roller 310*b* is the same as the gear ratio for the gear train from the motor 620 to the axle driving the front roller 310*a*, which is about 1:10 to 1:30 (e.g., between 1:10 and 1:15, between 1:15 and 1:20, between 1:20 and 1:25; between 1:25 and 1:30). In one particular example, the main brush spins at between 1200-1330 RPM and the corner brush is running between 50-100 RPM. From the motor shaft 625, the drivetrain 600 includes gears such that the motor 620 can drive both the rear roller 310*b* and front roller 310*a*. Side brush bevel gear 630 can drive a rear roller bevel gear 640*b* and a front roller bevel gear 640*a*. The mating angles between the side brush bevel gear 630 and rear roller bevel gear 640*b* can be 90 degrees or slightly offset from 90 degrees. Likewise, the mating angle between the side brush bevel gear 630 and front roller bevel gear 640*a* can also be 90 degrees or slightly offset from 90 degrees. The front roller bevel gear 640*a* can be coupled to the drive gear 655*a* coupled to a front roller axle 660*a*. The rear roller bevel gear 640*b* can be coupled to transfer gear 650*b*, 650*c*, which drives a drive gear 655*b* coupled to a rear roller axle 660*b*. The configuration shown in FIG. 6A-B allows a counter-clockwise rotation of the motor from the perspective of FIG. 6B to cause the portions closer to the floor of the rear and front rollers 310*a*-310*b* to rotate towards the gap G between the rollers.

Figure 7:
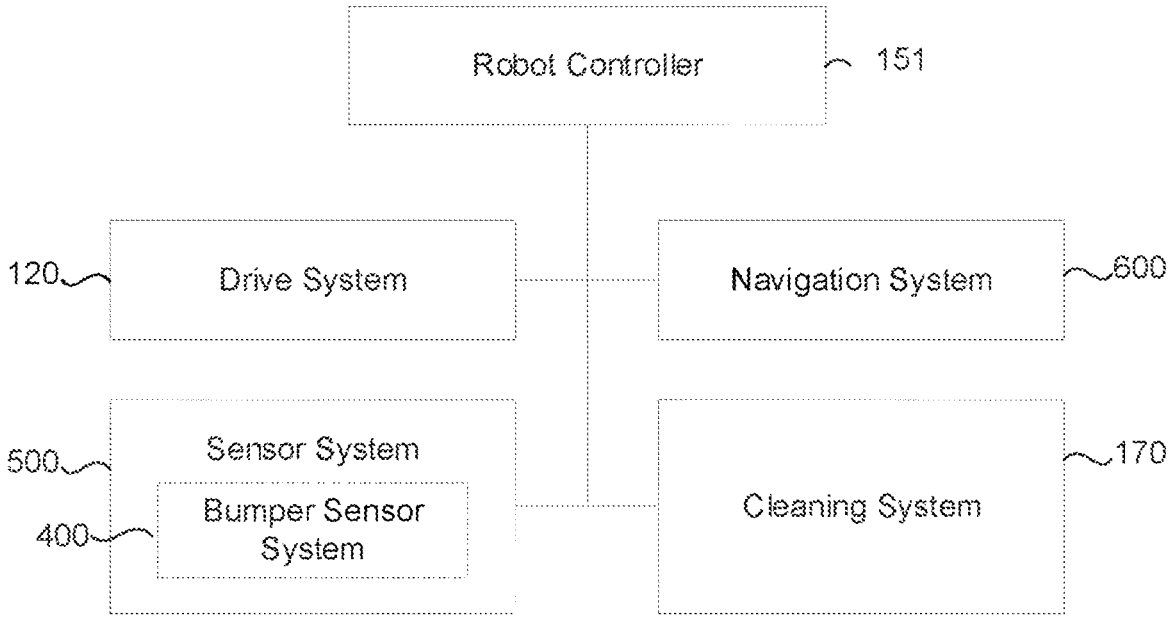
FIG. 7 is a block diagram of a controller of the robot and systems of the robot operable with the controller.

Referring to FIG. 7, to achieve reliable and robust autonomous movement, the robot 100 includes a robot controller 151 that operates cleaning system 170, a sensor system 500, a drive system 120, and a navigation system 600. The cleaning system 170 is configured to ingest debris with use of the rollers 310, the side brush 140, and the vacuum module 162.

The sensor system 500 having several different types of sensors 530 which can be used in conjunction with one another to create a perception of the robot's environment sufficient to allow the robot 100 to make intelligent decisions about actions to take in that environment. The sensor system 500 includes obstacle detection obstacle avoidance (ODOA) sensors, communication sensors, navigation sensors, contact sensors, a laser scanner, and an imaging sonar etc. Referring briefly to FIGS. 1A-B, the sensor system 500 further includes ranging sonar sensors 530*a*, proximity cliff sensors 530*b*, clearance sensors operable with the clearance regulators 128*a-b*, contact sensors operable with the caster wheel 126, and a bumper sensor system 400 that detects when the bumper 130 encounters an obstacle. Additionally or alternatively, the sensor system 530 may include, but not limited to, proximity sensors, sonar, radar, LIDAR (Light Detection And Ranging, which can entail optical remote sensing that measures properties of scattered light to find range and/or other information of a distant target), etc., infrared cliff sensors, contact sensors, a camera (e.g., volumetric point cloud imaging, three-dimensional (3D) imaging or depth map sensors, visible light camera and/or infrared camera), etc.

The drive system 120, which includes the wheel modules 120*a-b*, can maneuver the robot 100 across the floor surface based on a drive command having x, y, and θ components (shown in FIG. 1A). The controller 151 operates a navigation system 600 configured to maneuver the robot 100 in a pseudo-random pattern across the floor surface. The navigation system 600 is a behavior based system stored and/or executed on the robot controller 151. The navigation system 600 communicates with the sensor system 500 to determine and issue drive commands to the drive system 120.

The controller 151 (executing a control system) is configured to cause the robot to execute behaviors, such as maneuvering in a wall following manner, a floor sweeping manner, or changing its direction of travel when an obstacle is detected by, for example, the bumper sensor system 400. The robot controller 151 can be responsive to one or more sensors 530 (e.g., bump, proximity, wall, stasis, and/or cliff sensors) of the sensor system 500 disposed about the robot 100, as described earlier. The controller 151 can redirect the wheel modules 120*a*, 120*b* in response to signals received from the sensors 530, causing the robot 100 to avoid obstacles and clutter while treating the floor surface 10. If the robot 100 becomes stuck or entangled during use, the robot controller 151 may direct the wheel modules 120*a*, 120*b* through a series of escape behaviors so that the robot 100 can escape and resume normal cleaning operations.

The robot controller 151 can maneuver the robot 100 in any direction across the floor surface by independently controlling the rotational speed and direction of each wheel module 120*a*, 120*b*. For example, the robot controller 151 can maneuver the robot 100 in the forward F, rearward A, right R, and left L directions. As the robot 100 moves substantially along the fore-aft axis Y, the robot 100 can make repeated alternating right and left turns such that the robot 100 rotates back and forth around the center vertical axis Z (hereinafter referred to as a wiggle motion). Moreover, the wiggle motion can be used by the robot controller 151 to detect robot stasis. Additionally or alternatively, the robot controller 151 can maneuver the robot 100 to rotate substantially in place such that the robot 100 can maneuver away from an obstacle, for example. The robot controller 151 can direct the robot 100 over a substantially random (e.g., pseudo-random) path while traversing the floor surface.

Figure 8:
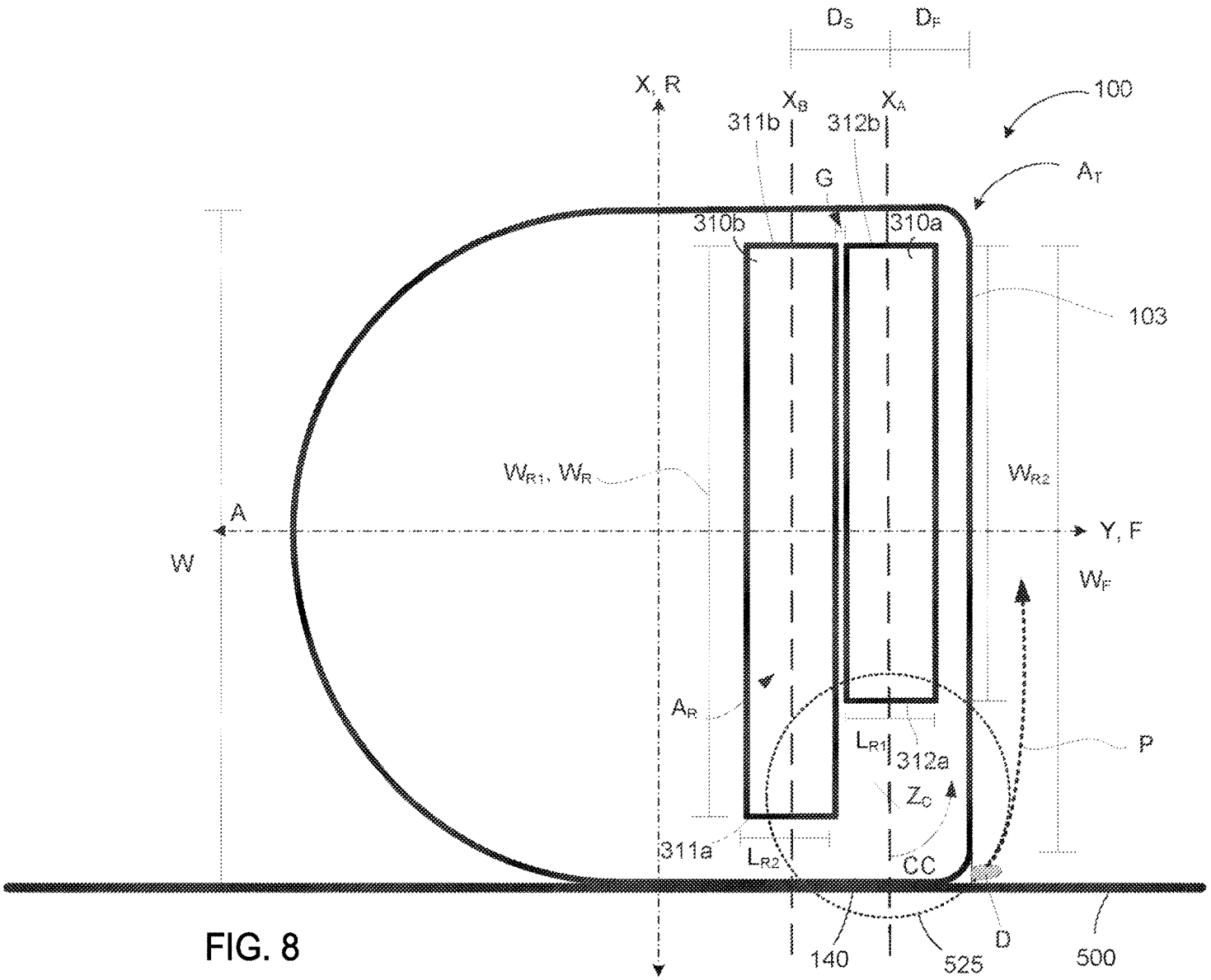
FIG. 8 is a simplified schematic top view of a cleaning system of the robot with an example piece of debris to be ingested by the robot.

FIG. 8 shows a simplified view of the bottom surface of the robot 100 with a body width W and a forward edge width $W_F$. The body width W is defined by the widest portion of the robot 100 as measured along the transverse axis X. The forward edge width $W_F$ refers to the width of the portion of the forward surface parallel to the transverse axis X. As the rollers 310*a-b* rotate, the outer surfaces of the rollers 310*a-b* that face the floor cooperate with one another to guide debris into the dust bin 102. A spacing distance $D_S$, measured along the Y-axis, between the longitudinal axes of rotation $X_A$, $X_B$ is greater than or equal to half of the sum of the diameters of the rollers 310*a-b*. Thus, a small gap G exists between rollers 310*a* and 310*b*. A front surface distance $D_F$, also measured along the Y-axis, defines the distance between the front longitudinal axis of rotation $X_A$ and the front surface 103, which is less than or equal to twice the diameter of the front roller 310*a*. In some examples, the front edge of the front roller 310*a* is less than about 2 cm from the front edge 103 of the robot (e.g., less than about 2 cm, less than about 1 cm, less than about 0.5 cm). The rear roller 310*b* is longer than the front roller 310*a*. The longer rear roller 310*b* includes two ends 311*a-b*, and the shorter front roller 310*a* includes two ends 312*a-b*. The distance between the two ends 311*a* and 311*b* defines the rear roller cleaning width $W_{R1}$, and the distance between the two ends 312*a* and 312*b* defines the front roller cleaning width $W_{R2}$. The width of the wider of the two rollers 310*a-b*, i.e. the rear roller 310*a*, defines the overall roller cleaning width $W_R$. The roller cleaning width $W_R$ indicates the span of the robot 100 that, as the robot 100 is driven forward or backward, will be capable of retrieving and ingesting debris with the mechanical motion of the rollers without the aid of the side brush. The roller cleaning width $W_R$ is at least about 75% of the width W of the forward portion 112 of the robot 100 (e.g., at least about 75%, at least about 80%, at least about 90%, at least about 95%). In some examples, a ratio of the front roller 310*a* cleaning width $W_{R1}$ to the rear roller 310*b* cleaning width $W_{R2}$ is between about 1:2 and 9:10 (e.g., between about 1:2 and 9:10; between about 6:10 and 9:10; between about 7:10 and 9:10; about 4:5; about 9:10). In some examples, the rear roller 310*b* cleaning width $W_{R2}$ can be at least about 0.5 inches (e.g., at least about 0.5 inches; at least about 0.75 inches; at least about 1 inch; at least about 1.5 inches; at least about 2 inches) greater than the front roller 310*a* cleaning width $W_{R1}$.

As described earlier, air can be pulled through the air gap G between the front roller 310*a* and the rear roller 310*b* by, for example, by an impeller housed within or the vacuum module 162 (shown in FIG. 1C). The impeller can pull air into the cleaning head from the environment below the cleaning head, and the resulting vacuum suction can assist the rollers 310 in raising dirt and debris from the environment below the rollers 310 through the air gap G between the front roller 310*a* and the rear roller 310*b* into the dust bin 202 (shown in FIG. 1C) of the robotic vacuum. Ends 311*a-b* have lengths of $L_{R2}$ and ends 312*a-b* have lengths of $L_{R1}$, which are equal to the diameters of the rollers 310*a* and 310*b*, respectively. In the schematic as shown, the rollers 310*a-b* cooperate to form a roller coverage region, defined by the sum of the projected area of each roller and the projected air gap area. The area $A_R$ of the roller coverage region can be determined by equation (1) below:

$$A_R = L_{R1}W_{R1} + L_{R2}W_{R2} + GW_{R2} \quad (1)$$

In the implementation as shown, the roller coverage region area $A_R$ covers between 10% and 50% of the total projected floor area $A_T$ of the robot 100. In some examples, the roller coverage region area $A_R$ covers between 25% and 35% of the total projected floor area $A_T$ of the robot 100.

While the side brush 140 is rotating in a counterclockwise sense CC, any object on the floor surface in a substantially circular side brush cleaning region 525 contacts the side brush 140. The struts and the bristles that protrude from the struts sweep the side brush cleaning region 525 as the axle rotates about the axis $Z_C$. The side brush cleaning region 525 sweeps under the outer surfaces of the rollers 310. The side brush 140 can generate the side brush cleaning region 525 that extends beyond the floor projection of the robot body 110 so that the robot can clean difficult-to-reach locations. The side brush cleaning region 525 can extend beyond both the front surface 103 of the robot body 110 and the lateral surface 104*a* of the robot body 110. In the example as shown, the roller end 311*a* extends farther than the side brush axis $Z_C$ as measured along the X axis by about 0.5 cm to 5 cm. In some examples, the side brush includes bristles having a length that extends to the shorter of the rollers. In some additional examples, the side brush includes bristles having a length that extends past an intersection of a line extending from the generally straight side surface and a line extending generally parallel to the front generally flat surface. The struts and bristles may be positioned to contact the outer surfaces of the rollers 310 or may sweep under the rollers 310 without contacting them.

Methods of Use

Figure 9:
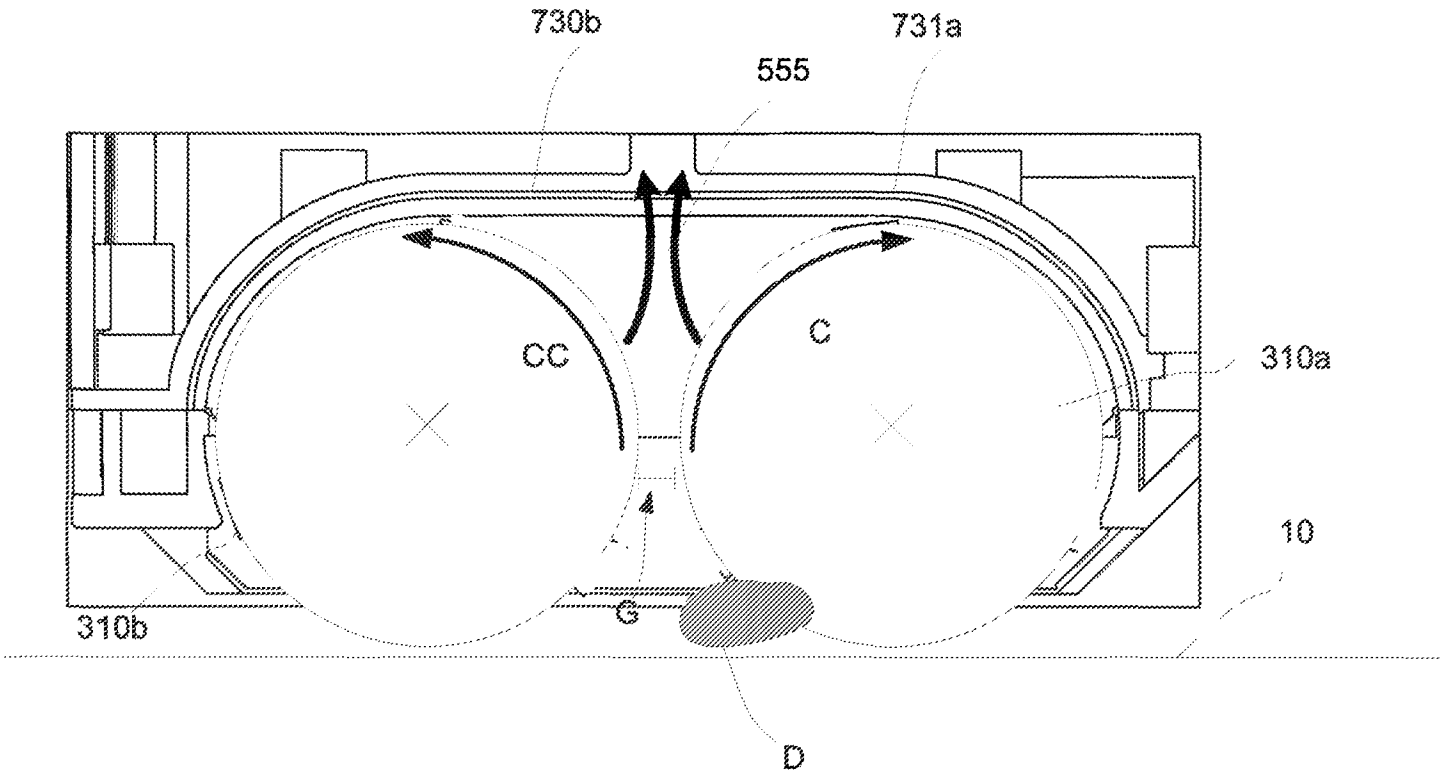
FIG. 9 is a simplified schematic side view of the rollers of the cleaning system of the robot with an example piece of debris to be ingested by the robot.

FIG. 8 further illustrates the sweeping of a large piece of debris D by the side brush 140 of the robot 100 as the robot 100 moves forward along a wall 500. FIGS. 8-9 together illustrate the process of facilitating the ingestion of the large piece of debris D. The robot 100 is in use and is being driven by its wheels to move in a forward direction F. The rollers 310*a* and 310*b* are rotating such that the roller surfaces closest to the ground are moving towards the gap between the rollers 310*a-b*. The side brush 140 is being driven in a counterclockwise sense CC so that the portions of the side brush that extend past the robot body are rotating towards the center axis Y of the robot 100. The robot 100 has encountered the wall 500 and has navigated into a position such that the side surface of the robot 100 is substantially parallel and in close proximity to the wall 500.

The large piece of debris D initially sits against the wall 500 such that, as the robot 100 moves along the wall in the forward direction F, the large piece of debris D has a distance farther from the Y-axis than the rear roller end 311*a*. Said another way, the roller cleaning width $W_R$ initially does not encompass the piece of debris D. Still referring to FIG. 8, the robot moves along the wall 500 such that the side brush cleaning region 525 can reach the corner defined by the wall 500 and the floor. As shown, the side brush cleaning region 525 interferes with the wall, but the flexible structure of the side brush 140 allows the side brush 140 to deform in response to contact with the wall. When the robot reaches the large piece of debris D, the large piece of debris D enters the side brush cleaning region 525 and is agitated by the side brush 140 so that it takes a path P that generally follows the counterclockwise rotation of the side brush 140. The side brush 140 forces the debris D to a position closer to the Y-axis than the rear roller end 311*a*. As a result, the debris D is moved into a forward path of the roller cleaning width $W_R$ and can be ingested by the rollers. As the robot is driven forward, the large piece of debris D contacts the front roller 310*a*. The front roller 310*a* which sits closer to the floor than the rear roller 310*b*, directs the debris D towards the gap G between the rear and front rollers.

FIG. 9, a side cross section view of the rollers, now shows the debris D after it has been directed towards the gap G between the rollers. As shown, the front roller 310*a* rotates in a counterclockwise sense CC and the rear roller 310*b* rotates in a clockwise sense C. The front roller 310*a* rotates counterclockwise in this perspective such that the portion closer to the floor 10 rotates towards the gap G into the plenums 730*a-b*. The rear roller 310*b* rotates towards the gap G as well and is thus rotating clockwise. As discussed, the shroud cooperates with the rollers such that the vacuum module creates a path of air suction 555 focused from the gap G. The path of air suction 555 begins near the gap G and is directed inward towards the dust bin of the robot, facilitating suction of dirt and debris into the dust bin. As shown in FIG. 9, the rollers 310 are collapsible to allow the debris D to pass through the gap G, despite the size of the debris being larger than the gap between the rollers. After the debris has passed through the rollers 310, the rollers will retain (rebound to) their circular cross section due to their resiliency and the debris will move upward toward a dust bin conduit.

While the side brush axis is shown to be on the bottom surface of the robot, in some implementations, the side brush can extend from an inset portion of the bottom surface of the robot. The inset portion can raise and angle the side brush so that the side brush contacts the surface of the rollers as it rotates.

While sonar sensors are described herein as being arranged on the bumper, these sensors can be additionally or alternatively arranged at any of various different positions on the robot. For example, sonar sensors can be disposed on the side surfaces of the robot to allow the robot to predict incoming obstacles as it prepares to rotate.

While the wheel suspension bracket has been shown as a triangular piece of material that allows connections at three points to the spring, a wheel, and the robot body, in some implementations, the suspension bracket can be an L-shaped piece of material. The pivot points and anchor point can be located at substantially the same place as the pivot points and anchor point of the triangular version of the suspension bracket.

While an exemplary side brush has been shown and described, additional side brushes may be implemented to agitate debris from multiple directions of the robot. The number of struts may vary and the spacing may therefore also change.

While the side brush axis $Z_C$ has been described to form an angle less than 90 degrees with the bottom surface of the robot, in some implementations, the side brush axis can form an angle between 80 and 88 degrees with the bottom surface of the robot.

While the side brush axis $Z_C$ has been described to be disposed forward of the rear and front roller axes $X_B$, $X_A$, in some implementations, the side brush can be disposed rearward of the front roller axis and forward of the rear roller axis.

While the struts of the side brush have been described as flexible, in some implementations, the struts can be rigid. For example, struts that do not extend beyond the body of the robot do not impact nearby hard surfaces and obstacles as described earlier and thus can be rigid without risk of damage.

Figure 10:
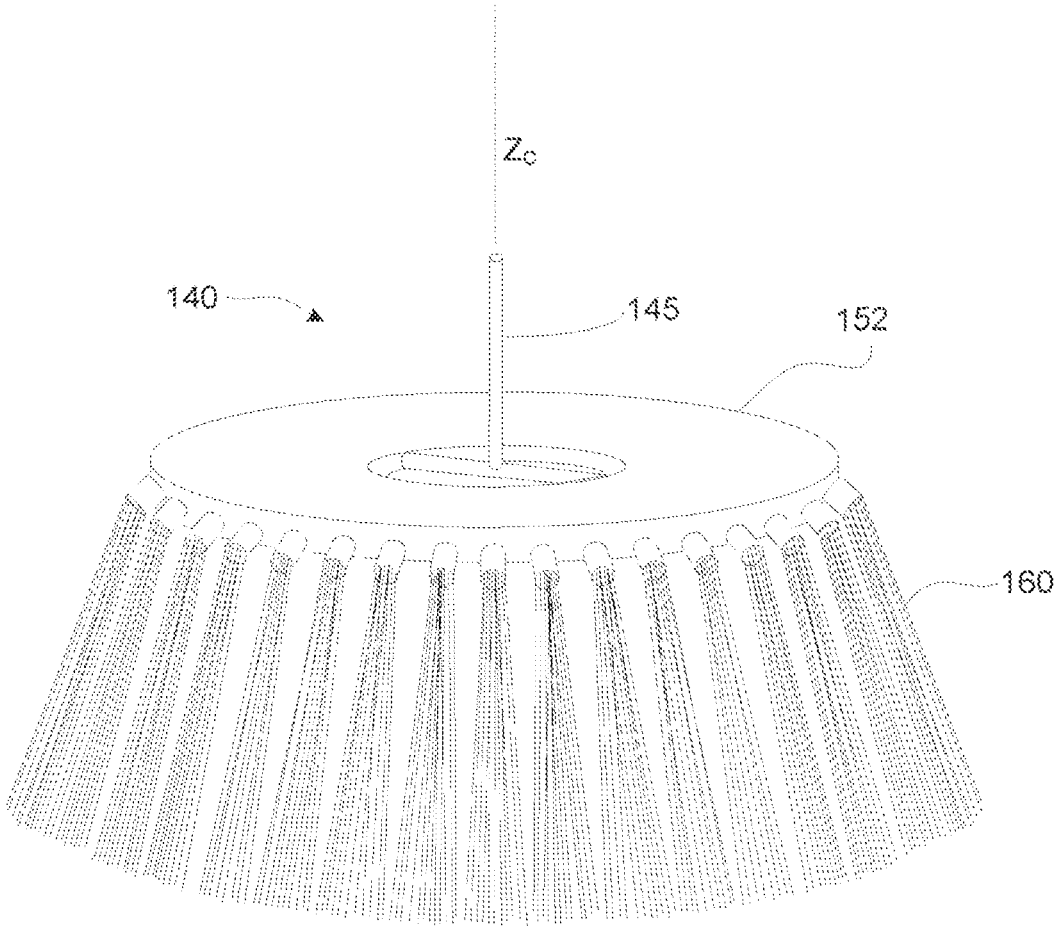
FIG. 10 is a perspective view of an implementation of the side brush of the robot where the side brush contains vertically oriented bristles.

While the axle of the side brush has been described as a separate component from the motor shaft, in some implementations, the axle of the side brush could be the motor shaft. In some examples, now referring to FIG. 10, an annular structure 152 can support bristles 160, which extend from the annular structure 152 at angle of about 25 to 35 degrees to the plane formed by the annular structure towards the floor, thus forming a circular brush to retrieve debris. In another example, the bristles can extend at an angle from one another such that they are crossed. As noted above, the cliff sensors are located under the reach of the side brush. As such, in order to allow the IR sensors to observe the flooring beneath the robot, the bristles can be grouped into bundles of bristles that extend to form a generally circular brush structure with gaps between the bundles of bristles. In general, as measured about the circumference of the circle formed by the bristles, between about 60% to about 90% (e.g., between about 60% and about 70%, between about 70% and about 80%, between about 80% and about 90%) of the circumference can be occupied by the bristles leaving about 10% to about 40% (e.g., between about 10% to about 20%, between about 20% to about 30%, between about 30% to about 40%) open to observe the IR reflection by the cliff sensors. The bristle materials may include synthetic fibers, animal or plant fibers, or other fibrous material known in the art.

The drivetrain described above is one example of a means of driving the robot rollers and side brush with a single mechanical energy source. Other power delivery systems or configurations of the drivetrain above can be implemented to rotate the rollers and side brush. While the drivetrain is described having the gear configuration as shown in FIG. 5, it should be understood that the gear ratios of the drivetrain can be modified as needed for torque, velocity, and rotation direction specifications of any implementation of the robot. The drivetrain can be modified to have additional or fewer gears to attain a desired gear ratio desired rotation sense. The drivetrain may also include a belt, a chain, or another means known in the art to transmit force over longer distances through the drivetrain. In implementations where the axis of the side brush creates an acute angle with the floor, one of the mating (rear roller or front roller) bevel gears could mate with the side brush bevel gear at less than 90 degrees, and the other mating bevel gear could mate with the side brush bevel gear at greater than 90 degrees.

While the drivetrain is described to simultaneously drive both rollers and the side brush, in some implementations, separate drivetrains can drive each roller and the side brush. In other implementations, a drivetrain can drive one roller and the side brush, and the other roller can be undriven or be driven by a separate drivetrain.

The rotational velocity of the front roller and the rear roller can be different than the rotational velocity of the motor output, and can be different than the rotational velocity of the impeller. The rotational velocity of the impeller can be different than the rotational velocity of the motor. In use, the rotational velocity of the front and rear rollers, the motor, and the impeller can remain substantially constant.

While a foam core has been described to support the tube of the rollers, in other implementations, curvilinear spokes replace all or a portion of the foam supporting the tube. The curvilinear spokes can support the central portion of the roller, between the two foam inserts and can, for example, be integrally molded with the roller tube and chevron vane.

While the rollers are shown to include six chevron vanes in one implementations, in other implementations, the rollers may have more or fewer vanes. For example, with larger flexible vanes, each vane can contact the floor for a longer period of time. As a result, fewer vanes can be used to maintain the same amount of floor contact time.

While the vane angle $\alpha$ is described to be about 45° relative to a radial axis, in some implementations, the angle $\alpha$ of the chevron vanes can be between 30° and 60° to the radial axis. Angling the chevron vanes in the direction of rotation can reduce stress at the root of the vane, thereby reducing or eliminating the likelihood of vane tearing away from the resilient tubular member. The one or more chevron vanes contact debris on a cleaning surface and direct the debris in the direction of rotation of the compressible roller.

While the angle between the legs of the V of the V-shaped chevrons has been described as 7°, in other implementations, the legs of the V are at a 5° to 10° angle relative a linear path traced on the surface of the tubular member and extending from one end of the tube to the other end. By limiting the angle $\theta$ to less than 10° the compressible roller can be more easily manufactured by molding processes. Angles steeper than 10° can create failures in manufacturability for elastomers having a durometer harder than 80 shore A.

While the tube has been described as elastomeric, in some implementations, the tube is injection molded from a resilient material of a durometer between 60 and 80 shore A. A soft durometer material than this range can exhibit premature wear and catastrophic rupture and a resilient material of harder durometer can create substantial drag (i.e. resistance to rotation) and can result in fatigue and stress fracture.

The rollers shown in this example comprise concentric layers. While each roller is shown and described to be continuous, in some implementations, at least one of the rollers, such as the front roller or the rear roller, can comprise two or more separate longitudinal roller segments rotating about the same axis of rotation. The segments of a single roller can each have their own driving mechanism or be coupled so that a single drivetrain can actuate all the segments. In other implementations, the lengths and diameters related to the roller (e.g. of the tube, the vanes, etc.) may vary.

While the vanes are shown to span continuously from the outer ends of the rollers to the center of the rollers, in some implementations, the vanes can discontinuously converge via segments that are along the same line. As these raised segments are not attached to one another, they are more flexible than a continuous vane. Further, while the rollers have been described to be continuous structures that span from one side of the robot to the other side of the robot, in some implementations, the front or rear roller can be split into sections that rotate about the same axis. For example, the front roller may have two equally sized sections that rotate about an axis $X_A$. A gap may be situated between the two sections.

While the length of the rear roller 310*b* has been described to be 7 inches and the length of the front roller 310*a* has been described to be 6 inches, in other implementations, the length of the rollers can be longer or shorter. For example, with a larger diameter side brush, the front roller can be, for example, half the length of the rear roller. The rear roller can be shorter as well with the larger diameter side brush.

In some implementations, the rollers are driven individually by corresponding brush motors or by one of the wheel drive motors or side brush motor. One roller may be driven independently from the other roller. The driven roller brush agitates debris on the floor surface, moving the debris into a suction path for evacuation to the collection volume.

Additionally or alternatively, one of the two rollers can be driven while the other is not driven but still has a rotational degree of freedom about its longitudinal axis. The driven roller brush may move the agitated debris off the floor surface and into a dust bin adjacent the roller brush or into one of the ducting. The driven roller may rotate so that the resultant force on the floor pushes the robot forward.

Moreover, the rollers may rotate in the same or opposite directions about their respective longitudinal axis $X_A$, $X_B$. Preferably, the rollers counter-rotate such that both of their facing surfaces move upward during floor cleaning, to help to draw debris into the robot. In some examples, the robot includes first and second roller motors. The first roller motor can be coupled to the front roller and drives the front roller brush in a first direction. The second roller motor can be coupled to the rear roller and drives the rear roller in a second direction opposite the first direction. The first direction of rotation may be a forward rolling direction with respect to the forward drive direction.

In some implementations the side brush axis $Z_C$ forms a 10-20 degree angle with the axis Z. While the side brush cleaning region is shown and described to be substantially round, it should be understood that greater offsets of the axis $Z_C$ from the floor surface result in a more oblong shape for the side brush cleaning region.

While the roller coverage region area $A_R$ has been described to occupy between 20% and 50% of the total projected area $A_T$ of the robot, in some implementations, the roller coverage region area can occupy a smaller or larger percent of the total projected area. For example, in cases where the side brush can sweep a larger area, the rollers can have a smaller width and still allow the robot to achieve a similar cleaning efficacy. Conversely, in cases where the side brush can sweep a smaller area, the rollers can have a larger width to achieve a similar cleaning efficacy.

While the path of air suction is shown to originate at the gap between the rollers, the path of air suction may extend to air substantially contacting the floor. The path of air flow may extend past the gap and towards the floor, further assisting the rollers in guiding the debris towards the dust bin.

Figure 11A:
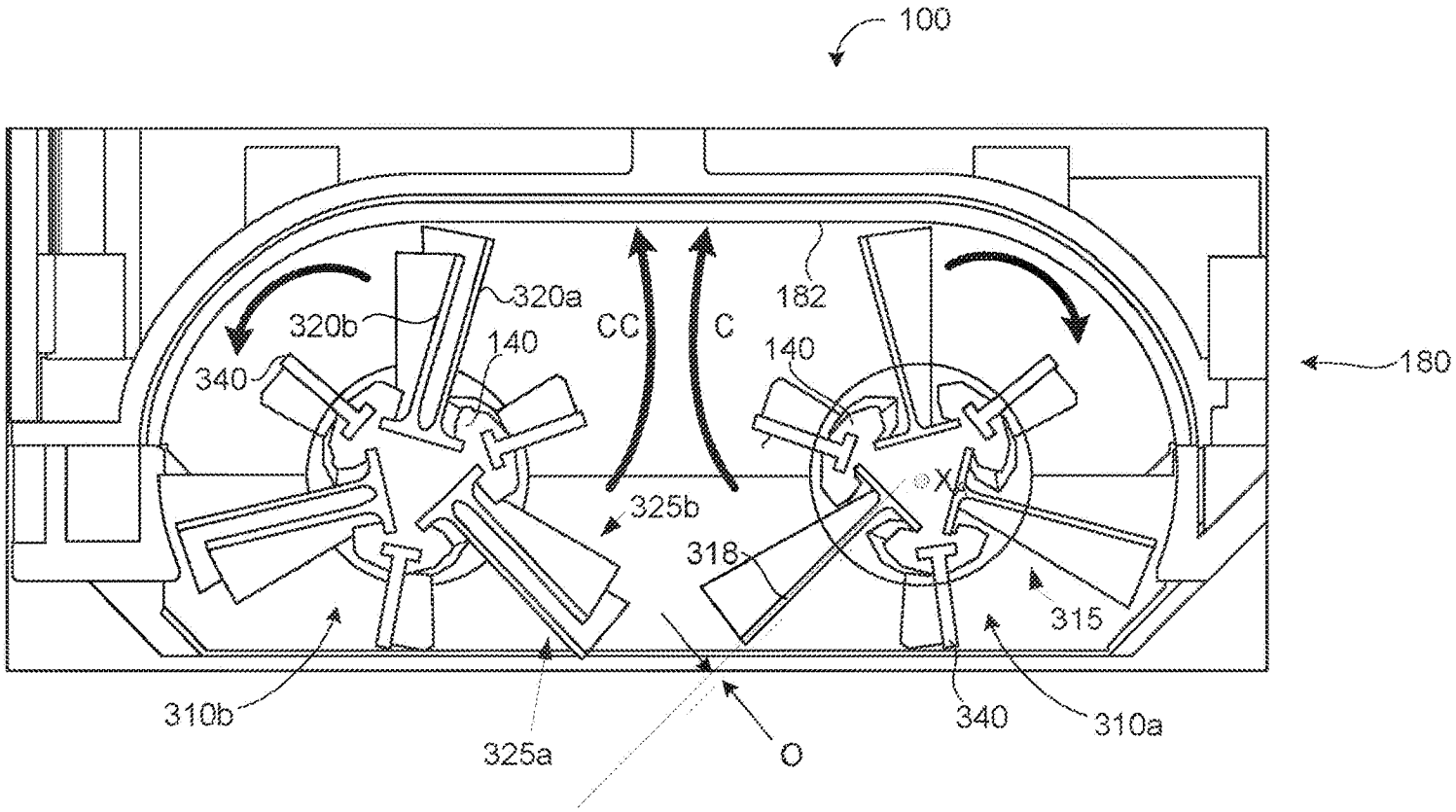
FIG. 11A is a side view of an implementation of the rollers of the robot where the rollers have rows of bristles.

In some implementations, the robot has at least one roller with bristles and/or beater flaps. The bristles are fibrous and can be made of synthetic or natural fibers, such as nylon or animal hair. FIG. 11A shows a side view of an example cleaning head 180 where the front roller 310*a* has three sets of one longitudinal row 315 of bristles 318 and the rear roller 310*b* has three sets of two longitudinal rows 325*a-b* of bristles 320*a-b*. The longitudinal rows 325*a-b* of a set are circumferentially spaced about the roller core 140. Each bristle 318, 320*a*, 320*b* has one end attached to the core 140 and the other end unattached. The bristles 318, 320*a*, 320*b* of the same row (e.g. rows 315, 325*a*, 325*b*) all have substantially the same length.

Each bristle 318, 320*a*, 320*b* has a bristle offset O, defined as how far forward or behind the rotation axis $X_A$, $X_B$ of the brush 310 the bristles 318, 320*a*, 320*b* are mounted with respect to the intended direction C of brush 310 rotation. Bristles 318, 320*a*, 320*b* mounted forward of the center axis $X_A$, $X_B$ will naturally be swept-back when contacting the floor 10, thus resulting in reduced power consumption compared to configurations of bristles mounted behind the center axes. Bristles 318, 320*a*, 320*b* mounted in front of the center axis $X_A$, $X_B$ of the roller 310 also yield longer bristles 318, 320*a*, 320*b* for the same effective diameter, creating a roller 310 that is relatively less stiff. As a result, a current draw or power consumption while traversing and cleaning a carpeted floor surface can be significantly reduced compared to a rear offset bristle configuration. The bristles 318, 320*a*, 320*b* have an offset of, for example, between 0 and 3 mm behind the center axis $X_A$, $X_B$ of the brush 310.

For the rear roller 310*b*, the first row 325*a* has bristles 320*a* of diameter 0.009 inches, and the second row has bristles 320*b* of diameter 0.005 inches. The first bristle row 325*a* (the larger diameter bristle row) is relatively less stiff than the second bristle row 325*b* (the smaller diameter bristle row) to impede filament winding about the roller core 140 (i.e., the shorter bristles are stiffer). As the robot 100 picks up hair from the surface 10, the hair may not be directly transferred from the surface to the dust bin, but rather may require some time for the hair to migrate from the brush 310 and into the plenum 182 and then to the dust bin. Flexible bristles reduce entrapment of the hair on the rollers, causing more deposition of the hair into the dust bin.

Rollers 310*a*, 310*b* are spaced apart such that distal second ends of their respective bristles 318, 320, 330 are distanced by a gap of, for example, about 1-10 mm. As the plenum 182 accumulates debris, the brushes 310*a*, 310*b* scrape the debris off the plenum 182, thus minimizing debris accumulation. The bristles 320*a-b* are long enough to interfere with the plenum 182 keeping the inside of the plenum 182 clean and allowing for a longer reach into transitions and grout lines on the floor surface 10. The bristles 320*a-b* are also long enough to interfere with the bristles 318.

Both brushes 310*a*, 310*b* include vanes 340 arranged between and substantially parallel to the rows 315 of bristles 318 or dual-rows 325 of bristles 320, 330. Each vane 340 includes an elastomeric material with one end attached to the core 140 to the other end free. The vanes 340 prevent hair from wrapping about the roller core 314. Additionally, the vanes 340 keep the hair towards the outer portion of the roller core 314 for easier removal and cleaning.

Figure 11B:
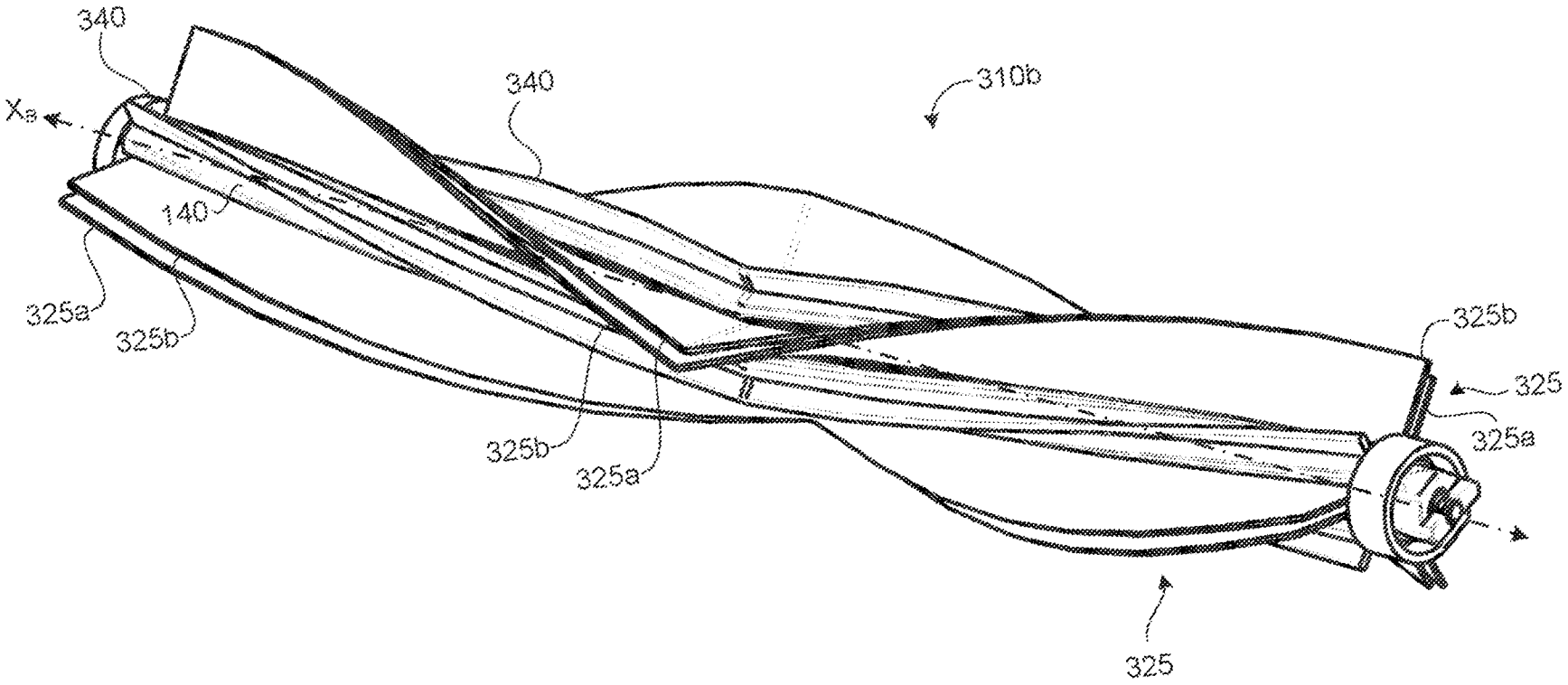
FIG. 11B is a perspective view of one of the rollers of FIG. 11A.

FIG. 11B is perspective view of the rear roller 310*b*. Referring to FIG. 11B, the vanes 340 define a chevron shape on the core 140. The vanes 340 are shorter than the bristles 318, 320, 330. The vanes 340 facilitate the removal of hair wrapped around the core 140 because the vanes 340 prevent the hair from deeply wrapping tightly around the roller core 314. The vanes 340 increase the airflow past the rollers 310*a*, 310*b*, which in turn increases the deposition of hair and other debris into the dust bin 202*b*. Since the hair is not deeply wrapped around the core 140 of the roller 310, the vacuum can still pull the hair off the roller 310. The first and second bristle rows 325*a*, 325*b* are separated circumferentially along the core 140 by a narrow gap. The rows 325*a*, 325*b* also define a chevron shape on the core 140.

While the bristles of the first row were described to have diameter of 0.009 inches and the bristles of the second row were described to have a diameter of 0.005 inches, in some examples, the bristles of the first row have a bristle diameter of 0.003-0.010 inches and are adjacent and parallel to a bristles of the second row having a bristle diameter of between 0.001-0.007 inches.

While the bristles were described to have substantially the same length, bristles of one row may be longer than bristles of another row. For example, in the case of a roller with three sets of two longitudinal rows of bristles, the row farther offset from the roller axis of rotation can be shorter than the other row. The cascaded bristle length can ensure that that both rows of bristles have equal contact with the ground surface. In some examples, the bristle length of the farther offset row of bristles is less than 90% of the bristle length of the second row. In some implementations, the farther offset row may further be made of a different material composition than the bristles of other row. The bristle composition of the first row can be stiffer than the bristle composition of the second row. A combination of soft and stiff bristles, where the soft bristles longer than the stiff bristles, can allow the hair to be trapped in the longer soft bristles and therefore migrate to the collection bin faster. Additionally, the combination of denser and/or stiffer bristles enables retrieval of debris, particularly hair, from a myriad of surface types. The first row of bristles can be effective at picking up debris from hard flooring and hard carpet. The soft bristles can be better at being compliant and releasing collected hair into the plenum. As the cleaning system suctions debris from the floor surface, dirt and debris can adhere to the plenum of the cleaning head.

While the number of longitudinal rows are shown to be one or two, in other implementations, there can be three or more longitudinal rows of bristles for a set. The cleaning head may further include other elements to assist with cleaning. For example, the cleaning head can include a wire bail to prevent larger objects (e.g., wires, cords, and clothing) from wrapping around the brushes. The wire bails may be located vertically or horizontally, or may include a combination of both vertical and horizontal arrangement.

The robot may further include at least one brush bar arranged parallel to and engaging the bristles of one of the rollers. The brush bars can interfere with the rotation of the engaged rollers to strip fibers or filaments from the engaged bristles. As the rollers rotate to clean a floor surface, the bristles can make contact with the brush bar. The brush bars agitate debris (e.g., hair) on the ends of the brushes and swipes them into the vacuum airflow for deposition into the dust bin. The roller allows the robot to increase its collection of debris specifically hair in the dust bin, and reduce hair entangling on the brushes.

While the alternative implementation for the rollers described above includes bristles on both rollers, in some implementations, one roller can be an elastomeric roller of the exemplary implementation of this disclosure, and the other roller can be a brush roller as described above. Each roller in such a combination can be designed to pick up specific types of debris so that the robot can generally ingest many kinds of debris.

A number of implementations have been described. Nevertheless, it will be understood that various modifications may be made without departing from the spirit and scope of the disclosure. Accordingly, other implementations are within the scope of the following claims.

What is claimed is:

1. An autonomous cleaning robot comprising:

a first cleaning roller rotatably mounted to the robot;

a second cleaning roller rotatably mounted to the robot adjacent the first cleaning roller; the first cleaning roller and the second cleaning roller drivable to counter-rotate with respect to each other; and a side brush mounted beneath the robot and configured to be driven to rotate about a side brush axis, the side brush located forward of the first roller with respect to a forward drive direction of the cleaning robot, the side brush axis located laterally beyond an end of the second cleaning roller, and the first cleaning roller extending laterally beyond the side brush axis.

2. The autonomous cleaning robot of claim 1, wherein the side brush axis is located forward of a second roller rotation axis with respect to a forward drive direction of the cleaning robot.

3. The autonomous cleaning robot of claim 2, wherein the second cleaning roller is located forward of the first cleaning roller with respect to a forward drive direction of the cleaning robot.

4. The autonomous cleaning robot of claim 3, wherein the side brush is located with respect to the first cleaning roller and the second cleaning roller such that during rotation of the side brush, bristles of the side brush sweep under at least a portion of each of the first cleaning roller and the second cleaning roller.

5. The autonomous cleaning robot of claim 4, wherein the side brush is located with respect to the first cleaning roller such that during rotation of the side brush, bristles of the side brush extend substantially across a diameter of the first cleaning roller.

6. The autonomous cleaning robot of claim 1, wherein the side brush axis forms an angle with a bottom surface of the robot of less than 90 degrees.

7. An autonomous cleaning robot, comprising:

a motorized drive wheel mounted to the robot and configured to be driven to propel robot across a surface;

a rear cleaning roller and a front cleaning roller each rotatably mounted to the robot, the front cleaning roller and the rear cleaning roller drivable to counter-rotate with respect to each other and configured to engage the surface during rotation; and a side brush mounted beneath the robot and configured to be driven to rotate about a side brush axis, the side brush axis located forward of the rear roller, the side brush axis located laterally beyond an end of the front cleaning roller, and the rear cleaning roller extending laterally beyond the side brush axis.

8. The autonomous cleaning robot of claim 7, wherein the side brush is located with respect to the front cleaning roller and the rear cleaning roller such that during rotation of the side brush, bristles of the side brush sweep under at least a portion of each of the first cleaning roller and the second cleaning roller.

9. The autonomous cleaning robot of claim 8, wherein the side brush is located on a bottom forward portion of the robot and wherein the side brush axis forms an angle with a bottom surface of the robot of less than 90 degrees.

10. The autonomous cleaning robot of claim 7, wherein the rear cleaning roller extends laterally beyond the front cleaning roller.

11. The autonomous cleaning robot of claim 7, wherein the side brush axis forms an angle with a bottom surface of the robot of less than 90 degrees.

12. An autonomous cleaning robot comprising:

front and rear cleaning rollers mounted beneath the robot counter-rotatably with respect to each other, and respectively defining longitudinal front and rear cleaning roller axes defining a plane; and a side brush mounted beneath the robot and rotatable about a side brush axis extending through the plane, the side brush rotatable to define a sweep region that extends at least partially underneath a region between the front and rear cleaning rollers, and the rear cleaning roller extending laterally beyond the side brush axis.

13. The autonomous cleaning robot of claim 12, wherein the side brush axis is located forward of the front cleaning roller axis.

14. The autonomous cleaning robot of claim 13, wherein the side brush is located with respect to the first cleaning roller such that during rotation of the side brush, bristles of the side brush extend substantially across a diameter of the first cleaning roller.

15. The autonomous cleaning robot of claim 12, wherein the rear roller extends laterally beyond the side roller.

16. The autonomous cleaning robot of claim 12, wherein the side brush is located on a bottom forward portion of the robot and wherein the side brush axis forms an angle with a bottom surface of the robot of less than 90 degrees.

* * * * *